US009989868B2

(12) United States Patent
Kami et al.

(10) Patent No.: US 9,989,868 B2
(45) Date of Patent: Jun. 5, 2018

(54) PHOTOCONDUCTOR, IMAGE FORMING METHOD USING THE SAME, METHOD OF MANUFACTURING THE PHOTOCONDUCTOR, AND IMAGE FORMING APPARATUS

(71) Applicants: Hidetoshi Kami, Shizuoka (JP); Nobutaka Eguchi, Kanagawa (JP); Akihiro Sugino, Shizuoka (JP); Keisuke Shimoyama, Shizuoka (JP)

(72) Inventors: Hidetoshi Kami, Shizuoka (JP); Nobutaka Eguchi, Kanagawa (JP); Akihiro Sugino, Shizuoka (JP); Keisuke Shimoyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 14/717,319

(22) Filed: May 20, 2015

(65) Prior Publication Data

US 2015/0346613 A1 Dec. 3, 2015

(30) Foreign Application Priority Data

May 29, 2014 (JP) ..... 2014-111020
Oct. 9, 2014 (JP) ..... 2014-208039

(51) Int. Cl.

| | |
|---|---|
| ***G03G 5/047*** | (2006.01) |
| ***G03G 5/043*** | (2006.01) |
| ***G03G 5/05*** | (2006.01) |
| ***G03G 5/10*** | (2006.01) |

(52) U.S. Cl.

CPC ..... *G03G 5/043* (2013.01); *G03G 5/047* (2013.01); *G03G 5/0517* (2013.01); *G03G 5/0525* (2013.01); *G03G 5/0564* (2013.01); *G03G 5/10* (2013.01)

(58) Field of Classification Search

CPC ..... G03G 5/047

See application file for complete search history.

(56) References Cited

U.S. PATENT DOCUMENTS

| | | | |
|---|---|---|---|
| 6,326,112 | B1 | 12/2001 | Tamura et al. |
| 2007/0015074 | A1 | 1/2007 | Sugino et al. |
| 2007/0117033 | A1 | 5/2007 | Sugino et al. |
| 2007/0254224 | A1 | 11/2007 | Sugino |
| 2007/0287083 | A1 | 12/2007 | Gondoh et al. |

(Continued)

FOREIGN PATENT DOCUMENTS

| | | |
|---|---|---|
| JP | 2001-066963 | 3/2001 |
| JP | 2003-316033 | 11/2003 |

(Continued)

OTHER PUBLICATIONS

U.S. Appl. No. 14/612,637, filed Feb. 3, 2015.

*Primary Examiner* — Peter L Vajda

(74) *Attorney, Agent, or Firm* — Oblon, McClelland, Maier & Neustadt, L.L.P.

(57) ABSTRACT

Disclosed herein is a photoconductor containing an electroconductive substrate and a photosensitive layer, wherein, in a curve obtained by the steps (I) through (V) described herein, a surface of the photosensitive layer has a WRa (LML) of from 0.02 μm to 0.03 μm, a WRa (LHL) of from 0.006 μm to 0.01 μm, and a WRa (HLH) of 0.001 μm or less, where the arithmetical mean roughness (WRa) are defined as Ra in JIS-B0601:2001 and WRa (HHH) to WRa (LLL) represent individual Ra's as described herein.

9 Claims, 8 Drawing Sheets

(56) References Cited

U.S. PATENT DOCUMENTS

| | | | |
|---|---|---|---|
| 2008/0112742 | A1 | 5/2008 | Nakamori et al. |
| 2008/0113285 | A1 | 5/2008 | Nakamori et al. |
| 2009/0180804 | A1 | 7/2009 | Kurimoto et al. |
| 2010/0290807 | A1 | 11/2010 | Shimoyama et al. |
| 2010/0316423 | A1 | 12/2010 | Kami et al. |
| 2011/0076057 | A1 | 3/2011 | Kami et al. |
| 2012/0008984 | A1 | 1/2012 | Kami et al. |
| 2012/0163860 | A1 | 6/2012 | Shimoyama et al. |
| 2012/0237228 | A1 | 9/2012 | Kami |
| 2013/0022902 | A1 | 1/2013 | Shimoyama et al. |
| 2013/0059243 | A1 | 3/2013 | Hirose et al. |
| 2014/0193185 | A1 | 7/2014 | Kami et al. |

FOREIGN PATENT DOCUMENTS

| | | |
|---|---|---|
| JP | 2004-205947 | 7/2004 |
| JP | 2005-031433 | 2/2005 |
| JP | 2009-156978 | 7/2009 |
| JP | 2009-204462 | 9/2009 |
| JP | 2010-217598 | 9/2010 |
| JP | 2010-244002 | 10/2010 |
| JP | 2011-002480 | 1/2011 |
| JP | 2012-063720 | 3/2012 |
| JP | 2012-208468 | 10/2012 |
| JP | 2013-195876 | 9/2013 |
| JP | 2014-134605 | 7/2014 |

PHOTOCONDUCTOR, IMAGE FORMING METHOD USING THE SAME, METHOD OF MANUFACTURING THE PHOTOCONDUCTOR, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2014-111020 and 2014-208039, filed on May 29, 2014 and Oct. 9, 2014, respectively, in the Japan Patent Office, the entire disclosures of which are hereby incorporated by reference herein.

BACKGROUND

Technical Field

The present invention relates to a photoconductor, an image forming method utilizing the photoconductor, a method of manufacturing the photoconductor, and an image forming apparatus.

Background Art

In general, image forming apparatuses such as printers, photocopiers, facsimile machines which employ electrophotography form images through a series of processes of charging, irradiating, developing, transferring, and cleaning. The devices to conduct such image forming include at least a charger, an image irradiator, a developing device (reverse developing device), a transfer device, a cleaner, and an image bearing member (photoconductor). Image forming apparatuses having this kind of configuration are not free from problems of degradation of output images caused by blackened surface of the photoconductor during a long period of continuous use. When such background fouling occurs, the photoconductor is replaced with a fresh one. To meet increasing attentions for reduction of print cost and improvement of environmental performance, a photoconductors with further improved durability have been demanded.

Cleaning blades are popular as cleaning members used as cleaning devices for image forming apparatuses. A cleaning blade is formed by fixing a molded rubber blade having a plate-like form to a substrate such as an aluminum plate or iron plate. The edge of the blade is provided to be in contact with a photoconductor under constant load (pressure).

The blade edge is normally arranged in such a manner that the blade edge contacts a photoconductor in a counter direction (in which the blade edge bites into the photoconductor during rotation thereof, that is, the direction reversing to the rotation direction) in terms of cleaning property. The cleaning blade for use in this counter method is preferably formed of elastic materials, which easily imparts deflection rigidity to the cleaning blade. For example, when a photoconductor having a drum form is used, the cleaning blade is arranged in the counter direction to the drive (rotation) direction of the photoconductor with an angle θ to contact the photoconductor. Furthermore, the cleaning blade is pressed against the photoconductor in such a manner that the edge of the cleaning blade bites into the photoconductor to scrape off toner remaining on the surface of the photoconductor.

However, if the friction coefficient of the surface of the photoconductor increases under the contact conditions, the front edge surface of the cleaning blade is dragged and stretched so that a space having a wedge-like form appears between the stretched position and the surface of the photoconductor. The edge of the blade is dragged by the photoconductor and deformed like a wedge-like form. When the toner accumulates in the wedge-like space, the edge reacquires the original position by the elastic restoring force to stress occurring when the edge of the blade is dragged and deformed by the photoconductor. This is referred to as stick slip motion. When the photoconductor is driven in an image forming apparatus, the cleaning blade in contact with the photoconductor is more or less pulled into the drive direction of the photoconductor, which triggers stick slip motion.

The mechanism of this slip stick motion is inferred that at the point when the restoring force due to elasticity of a cleaning blade surpasses the maximum static frictional force thereof against a photoconductor, the cleaning blade moves in the restoring direction at once and thereafter moving of the cleaning blade stops as the restoring force is reduced and again is dragged in the drive direction. Unless this slip stick motion is stabilized in particular for an image forming apparatus for wide recording media for use in photocopying of design drawing, toner slips through the blade, which leads to occurrence of background fouling ascribable to cleaning performance so that it is inevitable that parts are replaced with fresh ones frequently.

SUMMARY

According to the present disclosure, provided is an improved photoconductor which includes an electroconductive substrate; and a photosensitive layer provided overlying the electroconductive substrate, wherein, in a curve obtained by (I) measuring a convexoconcave form by a surface texture and contour measuring instrument to make a single dimensional data arrangement, (II) conducting multi-resolution analysis (MRA-1) by wavelet conversion of the single dimensional data arrangement to separate into six frequency components of from a highest frequency component (HHH), a second frequency component (HHL), a third frequency components (HMH), a fourth frequency component (HML), a fifth frequency component (HLH), and a lowest frequency component (HLL), (III). making a single dimensional data arrangement by thinning out a single dimensional data arrangement of the lowest frequency component (HLL) of the six frequency components such that a number of data arrangement is reduced to 1/10 to 1/100, (IV) conducting further wavelet conversion for the single dimensional data arrangement obtained by thinning-out to conduct multi-resolution analysis (MRA-2) to separate into additional six the single dimensional frequency components of a highest frequency component (LHH), a second frequency component (LHL), a third frequency components (LMH), a fourth frequency component (LML), a fifth frequency component (LLH), and a lowest frequency component (LLL), and (V) of the twelve arithmetical mean roughness (WRa) of a total number of twelve frequency components obtained in (II) and (III), connecting logarithms of eleven WRa (LLL) to WRa (HHH) from left to right excluding WRa (HLL), the surface of the electroconductive layer has a WRa (LML) of from 0.02 μm to 0.03 μm, a WRa (LHL) of from 0.006 μm to 0.01 μm, and a WRa (HLH) of 0.001 μm or less.

The arithmetical mean roughness (WRa) are defined as Ra in JIS-B0601:2001 and WRa (HHH) to WRa (LLL) represent individual Ra's in the following bandwidths:

WRa (HHH): Ra in a bandwidth in which a cycle length of convexoconcave ranges from 0 μm to 3 μm;

WRa (HHL): Ra in a bandwidth in which a cycle length of convexoconcave ranges from 1 μm to 6 μm;
WRa (HMH): Ra in a bandwidth in which a cycle length of convexoconcave ranges from 2 μm to 13 μm;
WRa (HML): Ra in a bandwidth in which a cycle length of convexoconcave ranges from 4 μm to 25 μm.
WRa (HLH): Ra in a bandwidth in which a cycle length of convexoconcave ranges from 10 μm to 50 μm.
WRa (LHH): Ra in a bandwidth in which a cycle length of convexoconcave ranges from 26 μm to 106 μm.
WRa (LHL): Ra in a bandwidth in which a cycle length of convexoconcave ranges from 53 μm to 183 μm.
WR a (LMH): Ra in a bandwidth in which a cycle length of convexoconcave ranges from 106 μm to 318 μm.
WRa (LML): Ra in a bandwidth in which a cycle length of convexoconcave ranges from 214 μm to 551 μm.
WRa (LLH): Ra in a bandwidth in which a cycle length of convexoconcave ranges from 431 μm to 954 μm.
WRa (LLL): Ra in a bandwidth in which a cycle length of convexoconcave ranges from 867 μm to 1,654 μm.

BRIEF DESCRIPTION OF THE SEVERAL VIEWS OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

DETAILED DESCRIPTION

Figure 1:
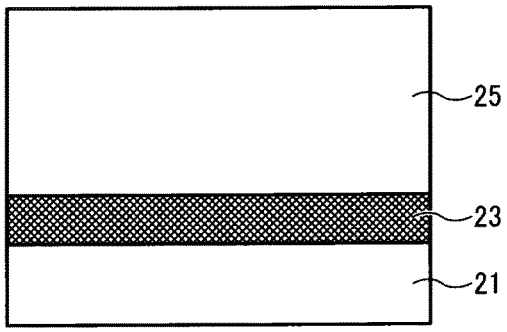
FIG. 1 is a cross section illustrating an example of the photoconductor according to an embodiment of the present disclosure.

The present disclosure provides a photoconductor that suppresses background fouling while having excellent durability.

The photoconductor in one embodiment of the present disclosure includes an electroconductive substrate; and a photosensitive layer provided overlying the electroconductive substrate, wherein, in a curve obtained by (I) measuring a convexoconcave form by a surface texture and contour measuring instrument to make a single dimensional data arrangement, (II) conducting multi-resolution analysis (MRA-1) by wavelet conversion of the single dimensional data arrangement to separate into six frequency components of from a highest frequency component (HHH), a second frequency component (HHL), a third frequency components (HMH), a fourth frequency component (HML), a fifth frequency component (HLH), and a lowest frequency component (HLL), (III). making a single dimensional data arrangement by thinning out a single dimensional data arrangement of the lowest frequency component (HLL) of the six frequency components such that a number of data arrangement is reduced to 1/10 to 1/100, (IV) conducting further wavelet conversion for the single dimensional data arrangement obtained by thinning-out to conduct multi-resolution analysis (MRA-2) to separate into additional six the single dimensional frequency components of a highest frequency component (LHH), a second frequency component (LHL), a third frequency components (LMH), a fourth frequency component (LML), a fifth frequency component (LLH), and a lowest frequency component (LLL), and (V) of the twelve arithmetical mean roughness (arithmetic mean deviations of profiles) (WRa) of a total number of twelve frequency components obtained in (II) and (III), connecting logarithms of eleven WRa (LLL) to WRa (HHH) from left to right excluding WRa (HLL), the surface of the electroconductive layer has a WRa (LML) of from 0.02 μm to 0.03 μm, a WRa (LHL) of from 0.006 μm to 0.01 μm, and a WRa (HLH) of 0.001 μm or less.

The arithmetical mean roughness (WRa) are defined as Ra in JIS-B0601:2001 and

WRa (HHH) to WRa (LLL) represent individual Ra's in the following bandwidths:

WRa (HHH): Ra in a bandwidth in which a cycle length of convexoconcave ranges from 0 μm to 3 μm;
WRa (HHL): Ra in a bandwidth in which a cycle length of convexoconcave ranges from 1 μm to 6 μm;
WRa (HMH): Ra in a bandwidth in which a cycle length of convexoconcave ranges from 2 μm to 13 μm;
WRa (HML): Ra in a bandwidth in which a cycle length of convexoconcave ranges from 4 μm to 25 μm.
WRa (HLH): Ra in a bandwidth in which a cycle length of convexoconcave ranges from 10 μm to 50 μm.
WRa (LHH): Ra in a bandwidth in which a cycle length of convexoconcave ranges from 26 μm to 106 μm.
WRa (LHL): Ra in a bandwidth in which a cycle length of convexoconcave ranges from 53 μm to 183 μm.
WR a (LMH): Ra in a bandwidth in which a cycle length of convexoconcave ranges from 106 μm to 318 μm.
WRa (LML): Ra in a bandwidth in which a cycle length of convexoconcave ranges from 214 μm to 551 μm.
WRa (LLH): Ra in a bandwidth in which a cycle length of convexoconcave ranges from 431 μm to 954 μm.
WRa (LLL): Ra in a bandwidth in which a cycle length of convexoconcave ranges from 867 μm to 1,654 μm.

Cleaning blades, which are widely used for cleaning members used as the cleaning device for image forming apparatuses, are involved with slip stick motion problem. The mechanism of this slip stick motion is inferred that at the point when the force to reacquire the original position of a cleaning blade due to the elasticity thereof surpasses the maximum static frictional force of the blade against a photoconductor, the cleaning blade moves in the reacquiring direction at once and thereafter the cleaning blade stops as the restoring force decreases and again is dragged in the drive direction. Unless this slip stick motion is stabilized in particular for an image forming apparatus for wide recording media for use in photocopying of design drawing, toner slips through the blade, which leads to occurrence of background fouling ascribable to cleaning performance so that it is inevitable that parts are replaced with fresh ones frequently.

To this problem, the present inventors thought that background fouling ascribable to this phenomenon can be reduced by imparting a particular convex form to the surface of a photoconductor because the vibration of the cleaning blade becomes according to the cycle of concave portions of the surface of the photoconductor, thereby stabilizing the contact between the blade and the photoconductor. The present inventors have made an investigation about the surface texture of a photoconductor at which the contact status between the photoconductor and a cleaning blade is stable and confirmed that the photoconductor having such a characteristic surface texture is advantageous to prolong the life length of the photoconductor with regard to background fouling. The present invention was thus made.

The multi-resolution analysis by wavelet conversion for the profile curve in the present disclosure is described in detail after the configuration of the photoconductor is described.

The surface texture of a photosensitive layer 25 preferably has an arithmetical mean roughness WRa (LML: Ra in a bandwidth in which a cycle length of convexoconcave ranges from 214 μm to 551 μm) of from 0.02 μm to 0.03 μm. The arithmetical mean roughness WRa is obtained by multi-resolution analysis (MRA-1) and multi-resolution analysis (MRA-2).

Background fouling is reduced for an extended period of time by changing the surface texture of the photosensitive layer 25 to a particular surface texture. At the same time, by making the surface texture have a WRa (LHL: Ra in a bandwidth in which a cycle length of convexoconcave ranges from 53 μm to 183 μm) of from 0.006 μm to 0.01 μm, the reduction becomes synergistic. Background fouling is caused by multiple mechanisms and these textures are considered to have advantages to reduce background fouling. This is confirmed particularly for a photocopier for wide recording media which has a photoconductor having a length of 900 mm or longer.

The surface texture of the photosensitive layer 25 has an impact on tribology characteristic of a photoconductor and other members that contact the photoconductor. Wettability (attachment force) with a development agent and shear stress accompanied by compression stress with a cleaning blade, which is normally a rubber plate, change with the surface texture of the photosensitive layer 25. With such good tribology characteristic, the photoconductor demonstrates good resistance for background fouling. In addition, the present inventors have also found that WRa (LML) preferably ranges from 0.02 μm to 0.03 μm. When WRa (LML) is less than 0.02 μm, blade abrasion is accelerated so that the cleaning property of an apparatus is not maintained for a long time, resulting in contamination of background. To the contrary, when WRa (LML) surpasses 0.03 μm, toner slips through the cleaning device and soils an output image. This is observed for Ra in a bandwidth in which a cycle length of convexoconcave ranges from 53 μm to 183 μm). That is, WRa (LHL) ranging from 0.006 μm to 0.01 μm is found to be extremely advantageous for the surface texture. In addition, WRa (HLH) has an impact on the shear force of a blade and WRa (HLH) being 0.001 μm or less is particularly good for cleaning. When WRa (HLH) is greater than 0.01 μm, a blade tends to be wound in so that a lubricant is added for solution.

Incidentally, in the present disclosure, WRa (HLH) is round off to three decimal places.

Such a surface texture is not formed by a dipping coating, which is most typical manufacturing method for an organic photoconductor. WRa (LML) and WRa (LHL) formed by dipping coating is about 0.01 μm and about 0.003 μm at highest, respectively.

The present disclosure is described by the configuration of a photoconductor. The photoconductor of the present disclosure includes at least the photosensitive layer 25 overlying a electroconductive substrate 21 and other optional layers such as an intermediate layer 23 or a protective layer 31. It is preferable to have the intermediate layer 23. Moreover, the photosensitive layer 25 can have a laminate structure of a charge generating layer 27 and a charge transport layer 29 in the thickness direction of the photosensitive layer 25.

FIG. 1 is a cross section illustrating an example of the structure of the photoconductor of the present disclosure in which the intermediate layer 23 and the photosensitive layer 25 are laminated on the electroconductive substrate 21. In the structure illustrated in FIG. 1, the photosensitive layer 25 is of a single layer type in which the features of charge generation and charge transport are not separated.

Figure 2:
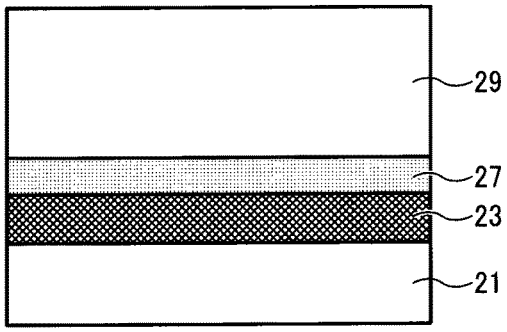
FIG. 2 is a cross section illustrating another example of the photoconductor according to an embodiment of the present disclosure.

FIG. 2 is a cross section illustrating another example of the structure of the photoconductor of the present disclosure in which the intermediate layer 23, the charge generating layer 27, and the charge transport layer 29 are laminated on the electroconductive substrate 21. In the structure illustrated in FIG. 2, the photosensitive layer 25 is of a laminate type in which the features are separated into the charge generating layer 27 and charge transport layer 29.

Figure 3:
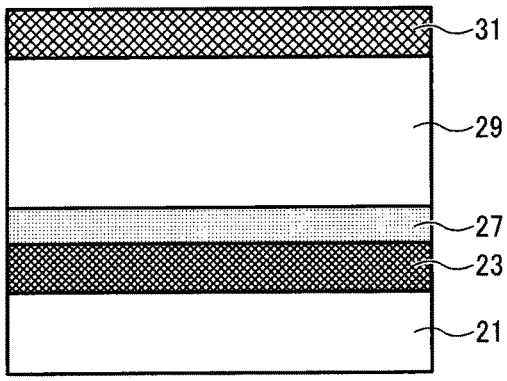
FIG. 3 is a cross section illustrating a yet another example of the photoconductor according to an embodiment of the present disclosure.

FIG. 3 is a cross section illustrating a yet another example of the photoconductor of the present disclosure and the protective layer 31 is provided on the charge transport layer 29 as in the structure illustrated in FIG. 2.

Electroconductive Substrate

The electroconductive substrate 21 can be formed by using material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by vapor deposition or sputtering. Also a board formed of nickel, and a stainless metal can be used. Furthermore, a tube which is manufactured from the board mentioned above by a crafting technique such as extruding and extracting and surface-treatment such as cutting, super finishing and grinding is also usable.

Tubes are used as the aluminum tube made of molding aluminum alloys of JIS 3003 series, JIS5000 series, JIS6000 series, etc. with typical methods such as EI method, ED method, DI method, and II method, or processed by surface cutting or polishing, anode oxidization.

In addition, the endless nickel belt and the endless stainless belt disclosed in JP-S52-36016-A can be used as the electroconductive substrate 21. In addition, as described above, to reduce the cost of an electroconductive substrate, a non-cut aluminum tube is also used.

As the non-cut aluminum tube, as disclosed in JP-H3-192265-A, DI tube, II tube, EI tube, and ED tube are known.

DI tube is made in such a manner that after an aluminum disk is subject to deep drawing to have a cup like form, the exterior surface thereof is finished with ironing. II tube is made in such a manner that after an aluminum disk is subject to impact processing to have a cup like form, the exterior surface thereof is finished with ironing. EI tube is made by finishing the exterior surface of aluminum extruded tube with ironing. ED tube is made by cold drawing after extrusion.

These non-cut aluminum tubes tend to cause production of defective images due to moire, etc. However, according to the present disclosure, as seen in Examples described later, no defective images due to moire, etc. are produced, so that a photoconductor that can produce quality images with good durability is obtained using such non-cut aluminum tube in the present disclosure.

In addition, a substrate processed from plastic to which a liquid application in which electroconductive powder is dispersed in a suitable binder resin is applied can be used as the electroconductive substrate 21 for use in the present disclosure. Specific examples of such electroconductive powders include, but are not limited to, carbon black, acetylene black, metal powder, such as powder of aluminum, nickel, iron, nichrome, copper, zinc and silver, and metal oxide powder, such as electroconductive titanium oxide powder electroconductive tin oxide powder, and ITO powder.

Specific examples of the binder resins which are used in combination with the electroconductive powder include, but are not limited to, thermoplastic resins, thermocuring resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenolic resin, and an alkyd resin.

Such an electroconductive layer can be formed by dispersing the electroconductive powder and the binder resin in a suitable solvent, for example, tetrahydrofuran (THF), dichloromethane, 2-butanone, and toluene, and applying the resultant liquid dispersion to an electroconductive substrate.

In addition, an electroconductive substrate formed by providing a heat contraction tube as an electroconductive layer on a suitable cylindrical substrate can be used as the electroconductive substrate 21 in the present disclosure. The heat contraction tube is formed of a material such as polyvinyl chloride, polypropylene, polyester, polystyrene, polyvinylidene chloride, polyethylene, chloride rubber, and polytetrafluoroethylene-based fluorine resin and the electroconductive powder mentioned above contained in the material.

Intermediate Layer

The intermediate layer 23 can be formed by using a liquid application of an intermediate layer containing a metal oxide and a binder resin (also referred to as resin) in a solvent. The intermediate layer 23 can also be formed by repeating applying the liquid application of intermediate layer while suitably drying the liquid application applied. When the layer is formed, mixing cyclohexanone with the liquid application of intermediate layer is advantageous in terms of easy-to-form. The boiling point and viscosity of cyclohexanone are inferred to contribute to this easy-to-form.

Specific examples of metal oxides include, but are not limited to, titanium oxide, zinc oxide, and those obtained by surface treatment thereof.

The intermediate layer 23 is mainly formed of a metal oxide and a binder resin. Considering that the photosensitive layer 25 is applied thereto in a form of solvent, the resin is preferably not or little soluble in general organic solvents.

Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenolic resins, alkyd-melamine resins, and epoxy resins.

The mass ratio (metal oxide/resin) of the metal oxide to the resin is preferably from 3/1 to 8/1. When the mass ratio is less than 1/3, the carrier transport power of the intermediate layer 23 easily deteriorates, which leads to occurrence of residual potential and degradation of photoresponsibility. When the mass ratio is greater than 8/1, voids in the intermediate layer 23 tend to increase so that air bubbles appear when the photosensitive layer 25 is applied to the intermediate layer 23.

The thickness of the intermediate layer 23 is suitably from 1.0 μm to 10 μm and more preferably from 4 μm to 7 μm.

Photosensitive Layer

Next, the photosensitive layer 25 is described. The photosensitive layer 25 takes a single layer structure or a laminate structure. Incidentally, the laminate structure and single layer structure do not regulate the number of layers. The laminate structure represents that the photosensitive layer is formed of the charge generating layer 27 having a charge generating power and the charge transport layer 29 having a charge transport power. The single layer structure represents that the photosensitive layer 25 has both a charge generating power and a charge transport power simultaneously.

Charge Generating Layer

The charge generating layer 27 contains at least a charge generating material and optionally a binder resin.

Specific examples of the binder resin include, but are not limited to, polyamides, polyurethanes, epoxy resins, polyketones, polycarbonates, silicone resins, acrylic resins, polyvinylbutyrals, polyvinylformals, polyvinylketones, polystyrenes, polysulfone, poly-N-vinylcarbazoles, polyacrylamides, polyvinyl benzale, polyester, phenoxy resin, copolymer of vinylchloride and vinyl acetate, polyvinyl acetate, polyphenylene oxide, polyamide, polyvinylpyridine, cellulose-based resin, casein, polyvinyl alcohol, and polyvinyl pyrolidone.

The content of the binder resin is from 0 part by weight to 500 parts by weight and preferably from 10 parts by weight to 300 parts by weight to 100 parts by weight of the charge generating material.

Specific examples of the charge generating material include, but are not limited to, phthalocyanine pigments, for example, metal phthalocyanine and metal-free phthalocyanine; azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, bis-benzimidazole pigments, azo pigments such as monoazo pigments, bisazo pigments, asymmetry disazo pimgents, trisazo pigments, and tetraazo pigments.

The charge generating layer 27 can be formed by applying a liquid application of charge generating layer to the intermediate layer 23 followed by drying. The liquid application can be prepared by dispersing a charge generating material and an optional binder resin in a suitable solvent using a ball mill, an attritor, a sand mill, or ultrasonic.

Specific examples of the solvents include, but are not limited to, isopropanol, acetone, methylethylketone, cyclohexanone, tetrahydrofuran, dioxane, dioxolane, ethylcellosolve, ethyl acetate, methylacetate, dichloromethane, dichloroethane, monochlorobenzene, cyclohexane, toluene, xylene, and ligroin.

Known methods such as a dip coating method, a spray coating method, a bead coating method, a nozzle coating method, a spinner coating method, and a ring coating method can be used as the application method of the liquid application.

The thickness of the charge generation layer 27 is suitably from about 0.01 μm to about 5 μm and preferably from 0.1 μm to 2 μm.

Charge Transport Layer

The charge transport layer 29 is mainly formed of a charge transport material. The liquid application of the charge transport layer is applied to the charge generating layer 27 followed by drying. In addition, the charge transport layer 29 can be formed of multi-layers having two or more layers by changing constitution materials. The liquid application of charge transport layer can be prepared by dissolving or dispersing a charge transport material and a binder resin in a suitable solvent.

Specific examples of such solvents include, but are not limited to, tetrahydrofuran, dioxane, dioxolane, anisole, toluene, monochlorobenzene, dichloroethane, methylene chloride, and cyclehexane.

The charge transport material is typified into a hole transport material and an electron transport material.

Specific examples of such electron transport material include, but are not limited to, electron acceptance materials such as chloranil, bromanil, tetracyano ethylene, tetracyanoquino dimethane, 2,4,7-trinitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, 3,5-dimethyl-3'5'-ditertiary butyl-4,4'-diphenoquinone, and benzoquinone derivatives. These charge transport materials can be used alone or in combination.

Specific examples of the hole transport materials include, but are not limited to, poly-N-vinylvarbazole) and derivatives thereof, poly-γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives, thiazole derivatives, triazole derivative, phenazine derivatives, acridine derivatives, benzofuran derivatives, benzimidazole derivatives, and thiophene derivatives. These hole transport materials can be used alone or in combination.

Specific examples of the binder resin for use in the charge transport layer 29 include, but are not limited to, thermoplastic resins or thermocurable resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins (bisphenol A type, bisphenol Z type, etc.), cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenolic resins, alkyd resins, and polycarbonate copolymers. (for example, JP-H5-158250-A and JP-H6-51544-A).

In the present disclosure, it is preferable to contain a thermoplastic resin. Of these, bisphenol Z type polycarbonate is preferable because it has good mechanical strength and good compatibility with chargeability and sensitive characteristic of a photoconductor. Of these, bisphenol Z type polycarbonate having a viscosity average molecular weight of from 40,000 to less than 50,000 is a particularly preferable material because it has an advantage to form a surface texture to improve the tribology characteristic between the photoconductor and the cleaning blade. Specific products thereof available on market include, but are not limited to, TS-2040 (manufactured by Teijin Chemicals Ltd.) and Iupilon Z400 (manufactured by Mitsubishi Engineering-Plastics Corporation).

Moreover, the binder resin for use in the charge transport layer 29 can be a charge transport polymer having a power as binder resin and a power as charge transport material. Specific examples of such charge transport polymers include, but are not limited to, the following.

(a) Polymers having a carbazole ring in its main chain and/or branch chain (for example, poly-N-vinyl carbazole, compounds disclosed in JP-S50-82056-A, JP-S54-9632-A, JP-S54-11737-A, and JP-H04-175337-A).

(b) Polymers having a hydrazone skeleton in its main chain and/or branch chain (for example, compounds disclosed in JP-S57-78402-A and JP-H03-50555-A).

(c) Polysiylene polymers (for example, compounds disclosed in JP-S63-285552-A, JP-H05-19497-A, and JP-H05-70595-A).

(d) Polymers having a tertiary amine structure in its main chain and/or branch chain (for example, N,N-bis(4-methylphenyl)-4-amino polystyrene and compounds disclosed in JP-H01-13061-A, JP-H01-19049-A, JP-H01-1728-A, JP-H01-105260-A, JP-H02-167335-A, JP-H05-66598-A, and JP-H05-40350-A).

The suitable content of the binder resin is from 0 parts by weight to 200 parts by weight to 100 parts by weight of the charge transport material.

In addition, a plasticizer, a leveling agent, an antioxidant, etc. can be optionally added to the charge transport layer 29. It is particularly preferable to contain a plasticizer.

Specific examples of the plasticizer include, but are not limited to, halogenized paraffin, dimethyl naphthalene, dibutyl phosphine, dioctyl phthalate, tricresyl phosphate, and polymers and copolymers of such as polyesters. Of these plasticizers, 1,4-bis(2,5-dimethylbenzyl)benzene is a particularly suitable material in terms of forming a surface texture to improve the tribology characteristic between a photoconductor and a cleaning blade, boosting gas barrier property which leads to amelioration of gas resistance of the photoconductor, and advantages for the sensitivity of the photoconductor. The content of the plasticizer is preferably 30 parts by weight or less based on 100 parts by weight of the binder resin.

Specific examples of the leveling agents include, but are not limited to, silicon oils such as dimethyl silicone oil and methylphenyl siliconeoil and polymers or oligomers having a perfluoroalkyl group in its side chain and its suitable content is 1 part by weight or less based on 100 parts by weight of the binder resin.

In addition, antioxidants can be added to improve environment resistance to oxidized gas such as ozone and NOx. Antioxidants can be added to any layer containing organic compounds. It is particularly suitable to add it to a layer containing a charge transport material.

Specific examples of the antioxidants include, but are not limited to, hindered phenol-based compounds, sulfur-containing compounds, phosphorine-containing compounds, hindered amine-based compounds, pyridine derivatives, piperidine derivatives, and morpholine derivatives. Its content is suitably 5 parts by weight or less based on 100 parts by weight of a binder resin.

The thickness of the thus-obtained charge transport layer 29 is suitably from about 5 μm to about 50 μm.

It is more preferably from 20 μm to about 40 μm and more preferably from 25 μm to about 35 μm.

In the case of the single layer structure, thermocuring reins, thermoplastic resins, plasticizers, leveling agents, and antioxidants are optionally added to the photosensitive layer 25.

Protective Layer

Optionally, fluorine-containing resins such as polytetrafluoro ethylene, silicone resins, and inorganic materials titanium oxide, aluminium oxide, tin oxide, zinc oxide, zirconium oxide, magnesium oxides, silica, and surface-treated materials thereof can be added to improve abrasion resistance. Also, charge transport materials can be added.

It is possible to utilize known application methods to form the protective layer 31.

The thickness of the protective layer 31 is suitably from about 0.1 μm to 10 μm.

In addition to these, known materials such as a-C and a-SiC formed by vacuum thin layer forming methods can be used for the protective layer 31.

In the present disclosure, another intermediate layer can be provided between the photosensitive layer 25 and the protective layer 31.

Generally, this another intermediate layer is mainly formed of a binder resin.

Specific examples of the binder resins include, but are not limited to, polyamide, alcohol soluble nylon resins, water soluble butyral resins, polyvinyl butyral, and polyvinyl alcohol. It is possible to utilize known application methods to form the another protective layer. The thickness of this intermediate layer is suitably from 0.05 μm to 2 μm.

In the present disclosure, it is preferable that cyclohexanone accounts for 10 ppm to 100 ppm in the photoconductor. When this range is satisfied, it indicates the drying condition described later is suitable and durability is further improved.

Surface Texture of Photosensitive Layer

As described above, the surface texture of the photosensitive layer 25 in the photoconductor of the present disclosure is measured and analyzed in the following procedure.

This following procedure is also true when the surface texture of the charge transport layer 29 is measured in a case in which the photosensitive layer 25 is formed of the charge transport layer 29 and the charge generating layer 27.

(I): Making single dimensional data arrangement by measuring by a surface texture and the contour form measuring device.

(II) Conducting multi-resolution analysis (MRA-1) by wavelet conversion of the single dimensional data arrangement to separate into six frequency components of from the highest frequency component (HHH), the second frequency component (HHL), the third frequency components (HMH), the fourth frequency component (HML), the fifth frequency component (HLH), and the lowest frequency component (HLL).

(III). Thinning out a single dimensional data arrangement of the minimum frequency component of the six frequency components such that the number of data arrangement is reduced to 1/10 to 1/100.

(IV) Conducting further wavelet conversion for the single dimensional data arrangement obtained by thinning-out to conduct multi-resolution analysis (MRA-2) to separate into additional six frequency components of the highest frequency component (LHH), the second frequency component (LHL), the third frequency component (LMH), the fourth frequency component (LML), the fifth frequency component (LLH), and the lowest frequency component (LLL).

(V) of the twelve arithmetic mean deviations of the total number of twelve frequency components obtained in (II) and (IV), connecting logarithms of eleven WRa (LLL) to WRa (HHH) excluding WRa (HLL).

WRa (LLH) and WRa (LHH) are defined from the thus-obtained curve.

The procedure described above is true to the analysis of the surface texture of the charge transport layer 29 and WRa (LLH) is defined from the obtained curve.

The multi-resolution analysis of the profile curve in the photosensitive layer 25 of the photoconductor is described in detail below (which is true to the charge transport layer 29).

In the present disclosure, the profile curve of the surface texture of the photosensitive layer 25 is obtained as defined in JIS B0601 to obtain a single dimensional data arrangement being the profile curve.

This single dimensional data arrangement being the profile curve can be obtained as digital signals by a surface texture and contour form measuring device or by A/D converting the analogue outputs from the surface texture and contour form measuring device.

In the present disclosure, the measuring length of the profile curve to obtain the single dimensional data arrangement is preferably a measuring length defined in JIS and is preferably from 8 mm to 25 mm.

The sampling interval is not greater than 1 μm and preferably from 0.2 μm to 0.5 μm. For example, when the measuring length of 12 mm is measured by the number of samplings of 30,720, the sampling interval is 0.390625 μm, which is suitable to conduct the present disclosure.

As described above, this single dimensional data arrangement is subject to multi-resolution analysis by wavelet conversion (MRA-1) to separate the single dimensional data arrangement into multiple frequency components {e.g., six components of (HHH), (HHL), (HMH), (HML), (HLH), and (HLL)} from the high frequency component (HHH) to the low frequency component (HLL).

Furthermore, another single dimensional data arrangement is made by thinning-out the obtained lowest frequency component (HLL). The thus-obtained single dimensional data arrangement is then subject to multi-resolution analysis by wavelet conversion (MRA-2) to separate the single dimensional data arrangement into multiple frequency components {e.g., six components of (LHH), (LHL), (LMH), (LML), (LLH), and (LLL)}. The arithmetical mean roughness are obtained for each frequency components (twelve components) and referred to as WRa in the present disclosure to distinguish from general arithmetical mean roughness represented by Ra.

In the present disclosure, the wavelet conversion in the present disclosure is conducted by using a software product MATLAB. Since the definition of the bandwidth is a constraint from a software point of view, there is no special meaning for the definitions for these bandwidths. In addition, WRa is limited by the definition of the bandwidth described above so that the coefficient changes accordingly as the bandwidth changes.

Individual bandwidths of HML components and HLH components, LHL components and LMH components, LMH components and LML components, LML components and LLH components, and LLH components and LLL components are overlapped. The reason of this overlapping is as follows.

In the wavelet conversion, original signals are decomposed into L (Low-pass components) and H (High-pass components) by the first wavelet conversion (Level 1) and L is further decomposed into LL and HL by wavelet conversion. If the frequency component f contained in the original signal matches the frequency F to be separated, f is the border of the separation so that it is separated into both L and H. This is unavoidable in the multi-resolution analysis. Therefore, it is suitable to set the frequency contained in the original signal so as to prevent monitored frequency bandwidths from being separated at the wavelet conversion as described above.

Wavelet Conversion (Multi-Resolution Analysis) and Symbols of Each Frequency

In the present disclosure, the wavelet conversion is conducted twice. The first wavelet conversion is referred to as wavelet conversion (MRA-1) and the second wavelet conversion is referred to as wavelet conversion (MRA-2). To distinguish the first conversion from the second conversion, H (first time) or L (second time) is put in front of the abbreviation of each frequency bandwidth for convenience.

Various wavelet functions can be used as mother wavelet functions for the first time and the second time wavelet conversion. Specific examples thereof include, but are not limited to, Daubecies function, haar function, Meyer function, Symlet function, and Coiflet function. In the present disclosure, haar function is used but the present invention is not limited thereto.

In addition, when multi-resolution analysis is conducted to separate data arrangement into multiple frequency components from the high frequency component to the low frequency component by wavelet conversion, the number of the components is preferably from 4 to 8 and more preferably 6.

In the present disclosure, after separation into the multiple frequency components by the first wavelet conversion, the thus-obtained lowest frequency component is thinned out and taken out (sampling) to make a single dimensional data arrangement reflecting the lowest frequency component. This single dimensional data arrangement is subject to the second wavelet conversion and thereafter, multi-resolution analysis is conducted to separate into the multiple frequency components from the high frequency component to the low frequency component.

In the thinning-out for the lowest frequency component (HLL) obtained from the first wavelet conversion (MRA-1), the number of data arrangement is reduced to 1/10 to 1/100.

By this thinning-out of the data, the frequency of the data is raised (widening the logarithm scale width of X axis). For example, if the number of the arrangement of the single dimensional arrangement obtained from the first wavelet conversion is 30,000, the number of arrangement becomes 3,000 after 1/10 thinning-out.

If this thinning-out level smaller than 1/10, for example, 1/5, the degree of raising the data frequency is not sufficient. Also, the data are not separated well even after multi-resolution analysis by the second wavelet conversion. If the thinning-out level is greater than 1/100, the frequency of the data becomes too high, the data are too concentrated into the high frequency components to be separated even after multi-resolution analysis by the second wavelet conversion.

As a way of thinning data, if the thinning-out degree is 1/100, the average of 100 pieces of data is obtained, which is set as the single representative point.

Figure 4:
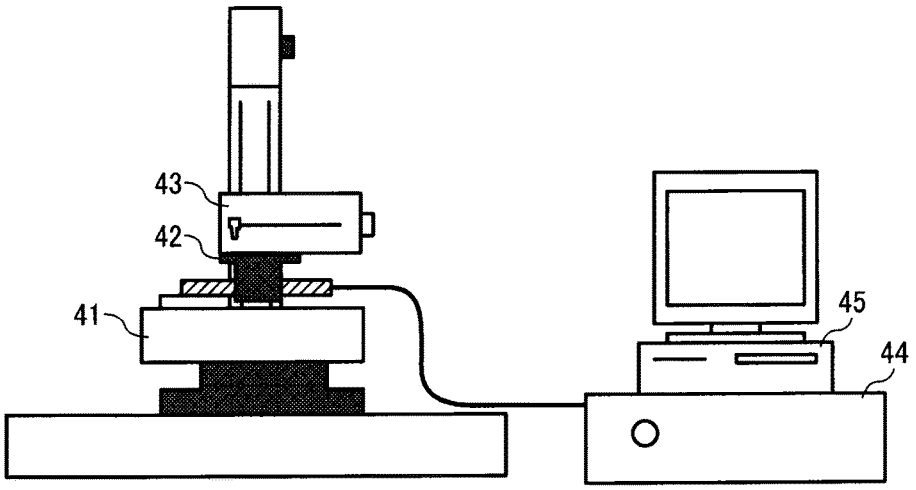
FIG. 4 is a view illustrating an example of the configuration of a surface roughness evaluation device of a photoconductor applied to the present disclosure.

FIG. 4 is a diagram illustrating an example of the configuration of a surface roughness evaluation device of the photoconductor, which is applied to the present disclosure.

In FIG. 4, 41 represents a photoconductor, 42 represents a jig to which a probe is mounted to measure the surface roughness of the photoconductor 41, 43 represents a mechanism (moving device of the probe) to move the jig 42 along a measuring target, 44 represents a surface texture and contour form measuring device, and 45 represents a home computer to analyze signals. In FIG. 4, the home computer 45 calculates the multi-resolution analysis described above. If the photoconductor takes a cylinder-like form, the surface roughness of the photoconductor is measured along any suitable direction, for example, the circumference direction or the longitudinal direction.

FIG. 4 is just an example for the illustration purpose only and any suitable configuration can be employed in the present disclosure. For example, a special numerical calculation processor can be used for the multi-resolution analysis instead of using a home computer. Moreover, this processing can be conducted by the surface texture and contour form measuring device. The result is shown by any suitable method, for example, displayed on a CRT or a liquid display, or printing. In addition, the result can be transmitted as electric signals to another device or stored in a USB memory or an MO disk.

In the measurement, the present inventors use the following devices:

- Surface texture and contour form measuring device: Surfcom 1400D (manufactured by Tokyo Seimitsu Co., Ltd.)
- Home computer: personal computer manufactured by International Business Machines Corp.
- Cable: RS-232-C cable to link Surfcom 1400D and the home computer of IBM.

Processing of the surface roughness data transmitted from Surfcom 1400D to the home computer and its multi-resolution analysis calculation are conducted by software coded by the present inventors, etc. based on C language.

Next, the procedure of the multi-resolution analysis for the surface texture of the charge transport layer of the photoconductor of the present disclosure is described with reference to specific examples (which is true to the surface texture of the photosensitive layer).

First, the surface texture of the photoconductor is measured by Surfcom 1400D (manufactured by Tokyo Seimitsu Co., Ltd.).

Each of the measuring length is 12 mm and the total number of samplings is 30,720. Four points are measured at once. The measuring results are taken in the home computer and thereafter subject to the first time wavelet conversion, thinning-out processing of 1/40 for the obtained lowest frequency component, and the second wavelet conversion using the program written by the present inventors, etc.

To the results of the multi-resolution analysis for the first time and the second time, the arithmetical mean roughness Ra, the maximum height Rmax, and the ten point height of irregularities Rz are obtained. An example of the calculation results is shown in FIG. 5A, FIG. 5B, FIG. 5C, and FIG. 5D.

Figures 5A, 5B, 5C, 5D:
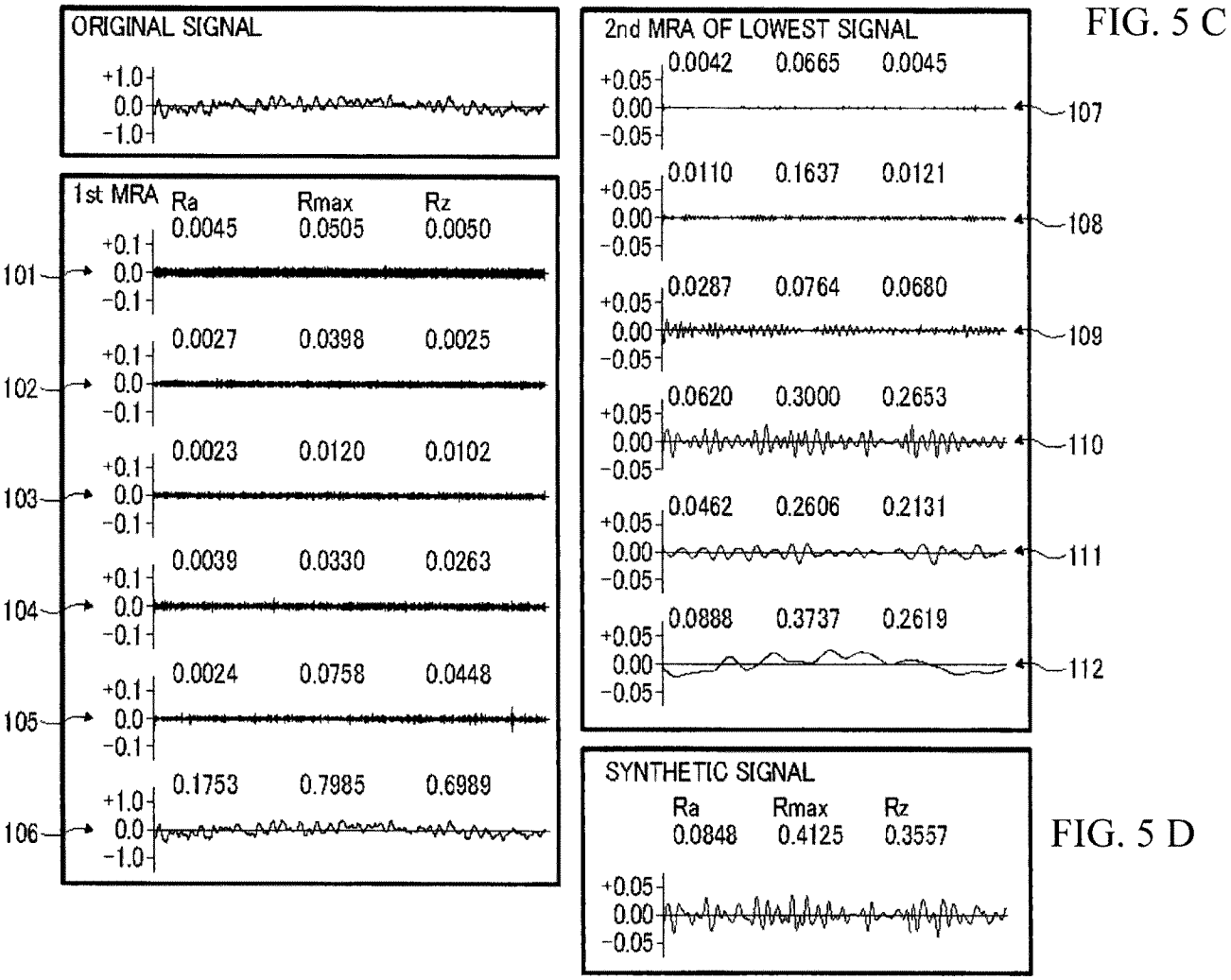
FIG. 5A, FIG. 5B, FIG. 5C, and FIG. 5D are graphs illustrating the calculation results of the first and the second multiresolution analyses.

The graph of FIG. 5A is formed by using the original data obtained by measuring the surface texture by Surfcom 1400D and is also referred to as a roughness curve or a profile curve.

There are 14 graphs in FIG. 5A, FIG. 5B, FIG. 5C, and FIG. 5D with a Y axis of the displacement of the surface texture with a unit of μm. The X axis represents the length and the measuring length is 12 mm although there is no scale thereon.

In the typical surface roughness measuring, the arithmetical mean roughness Ra, the maximum height Rmax, Rz, etc. are obtained from of FIG. 5A.

In addition, the six graphs in of FIG. 5B are the results of the first multi-resolution analysis (MRA-1). The graph situated at the top is the graph of the highest frequency components (HHH) and the graph situated at the bottom is the graph of the lowest frequency components (HLL).

In FIG. 5B, the graph 101 situated at the top is the highest frequency component of the results of the first multi-resolution analysis and is referred to as HHH in the present disclosure.

In FIG. 5B, the graph 102 is the frequency component (second frequency component) one below the highest frequency component of the results of the first multi-resolution analysis and is referred to as HHL in the present disclosure.

In FIG. 5B, the graph 103 is the frequency component (third frequency component) two below the highest frequency component of the results of the first multi-resolution analysis and is referred to as HMH in the present disclosure.

In FIG. 5B, the graph 104 is the frequency component (fourth frequency component) three below the highest frequency component of the results of the first multi-resolution analysis and is referred to as HML in the present disclosure.

In FIG. 5B, the graph 105 is the frequency component (fifth frequency component) four below the highest frequency component of the results of the first multi-resolution analysis and is referred to as HLH in the present disclosure.

In FIG. 5B, the graph 106 is the lowest frequency component of the results of the first multi-resolution analysis and is referred to as HLL in the present disclosure.

In the present disclosure, the graph illustrated in FIG. 5A is separated into the six graphs of FIG. 5B based on the frequency. The state of the frequency separation is illustrated in FIG. 6.

Figure 6:
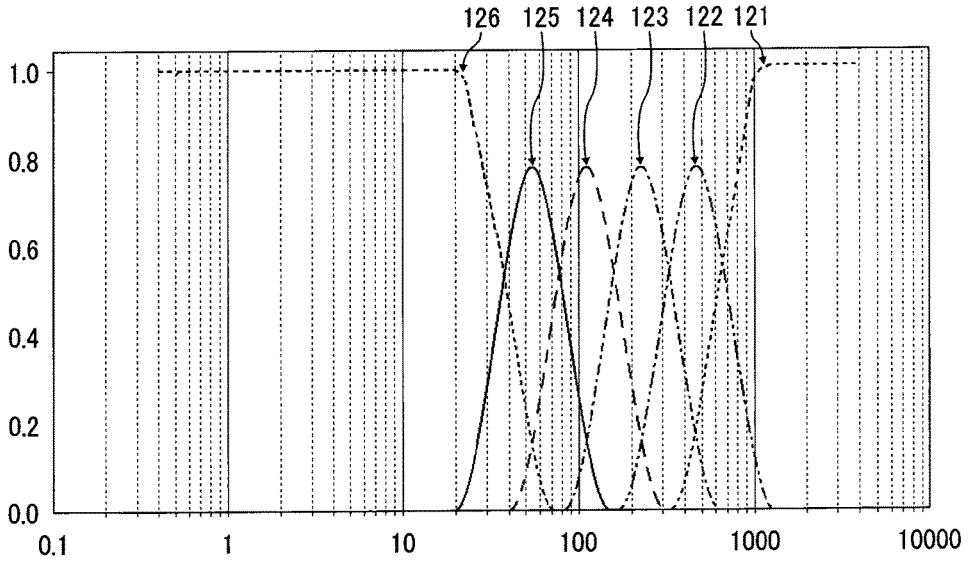
FIG. 6 is a graph illustrating separation of frequency bandwidth in multi-resolution analysis for the first time.

In FIG. 6, the X axis is the number of the convexoconcave portions per mm when the forms of the convexoconcave portions are regarded as sign waves. In addition, the Y axis indicates the ratio when separated into each bandwidth.

In FIG. 6, 121 represents the bandwidth of the highest frequency component (HHH) in the first multi-resolution analysis (MRA-1), 122 is the bandwidth of the frequency component (second frequency component) one below the highest frequency component (HHL) in the first multi-resolution analysis, 123 is the bandwidth of the frequency component (third frequency component) two below the highest frequency component (HMH) in the first multi-resolution analysis, 124 is the bandwidth of the frequency component (fourth frequency component) three below the highest frequency component (HML) in the first multi-resolution analysis, 125 is the bandwidth of the frequency component (fifth frequency component) four below the highest frequency component (HLH) in the first multi-resolution analysis, and 126 is the bandwidth of the lowest frequency component (HLL) in the first multi-resolution analysis.

FIG. 6 is described in detail. When the number of the convexoconcave portions per mm is 20 or less, all appears in the graph 126. For example, when the number of the convexoconcave portions per mm is 110, it appears most in the graph 124, which corresponds to HML in FIG. 5B. For example, when the number of the convexoconcave portions per mm is 220, it appears most in the graph 123, which corresponds to HMH in FIG. 5B. For example, when the number of the convexoconcave portions per mm is 310, it appears most in the graphs 122 and 123, which correspond to HHL and HMH in FIG. 5B. Therefore, which of the six graphs of FIG. 5B the highest ratio appears in is determined depending on the frequency of the surface roughness. In other words, in the surface roughness, fine roughness appears on the graphs situated on the top side in FIG. 5B and large surface waviness appears on the graphs on the bottom side in FIG. 5B.

In the present disclosure, the surface roughness is decomposed by the frequency. This is represented by the graphs of FIG. 5B. The surface roughness in each of the frequency bandwidth is obtained from the graph for each of these frequency bandwidths. As the surface roughness, the arithmetical mean roughness, the maximum height, and the ten point height of irregularities are calculated.

In FIG. 5B, the arithmetical mean roughness WRa, the maximum height WRmax, and the ten point height of irregularities WRz are shown in FIG. 5B.

"W" is put in front as in the arithmetical mean roughness WRa, the maximum height WRmax, and the ten point height of irregularities WRz of the roughness curve obtained by the wavelet conversion to separate them from the general representations.

In the present disclosure, as described above, the data measured by the surface texture and contour form measuring device are separated into multiple pieces of data by frequency so that the variance of the convexoconcave portions in each frequency bandwidth is measured.

Furthermore, in the present disclosure, the lowest frequency, i.e., HLL data are thinned out from the separated data as in FIG. 5B.

In the present disclosure, how to thin-out data, i.e., how may pieces of data are taken out is determined by experiments. By optimizing the number of thinning-out, the frequency bandwidth separation in the multi-resolution analysis illustrated in FIG. 6 can be optimized, thereby setting the target frequency as the center of the bandwidth.

Figure 7:
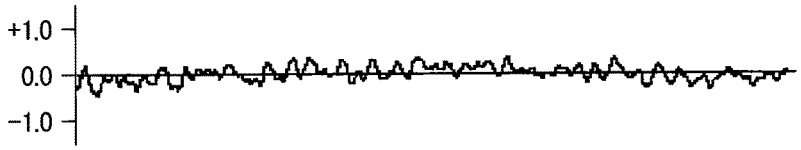
FIG. 7 is a graph illustrating the minimum frequency data in multi-resolution analysis for the first time.

In FIG. 5A, FIG. 5B, FIG. 5C, and FIG. 5D, a single piece of datum is taken out of 40 pieces of data in this thinning-out. The results of the thinning-out is shown in FIG. 7. In FIG. 7, the Y axis represents the surface roughness with a unit of μm. The X axis represents the length with a measuring length of 12 mm without a scale.

In the present disclosure, the data in FIG. 7 are further subject to multi-resolution analysis, which is the second multi-resolution analysis (MRA-2).

The six graphs in FIG. 5C are the results of the second multi-resolution analysis (MRA-2) and the graph 107 situated at the top is highest frequency component of the results of the second multi-resolution analysis, which is referred to as LHH.

The graph 108 is the frequency component (second frequency component) one below the highest frequency component of the results of the second multi-resolution analysis and is referred to as LHL.

The graph 109 is the frequency component (third frequency component) two below the highest frequency component of the results of the second multi-resolution analysis and is referred to as LMH.

The graph 110 is the frequency component (fourth frequency component) three below the highest frequency component of the results of the second multi-resolution analysis and is referred to as LML.

The graph 111 is the frequency component (fifth frequency component) four below the highest frequency component of the results of the second multi-resolution analysis and is referred to as LLH.

The graph 112 is the lowest frequency component of the results of the second multi-resolution analysis and is referred to as LLL.

Figure 8:
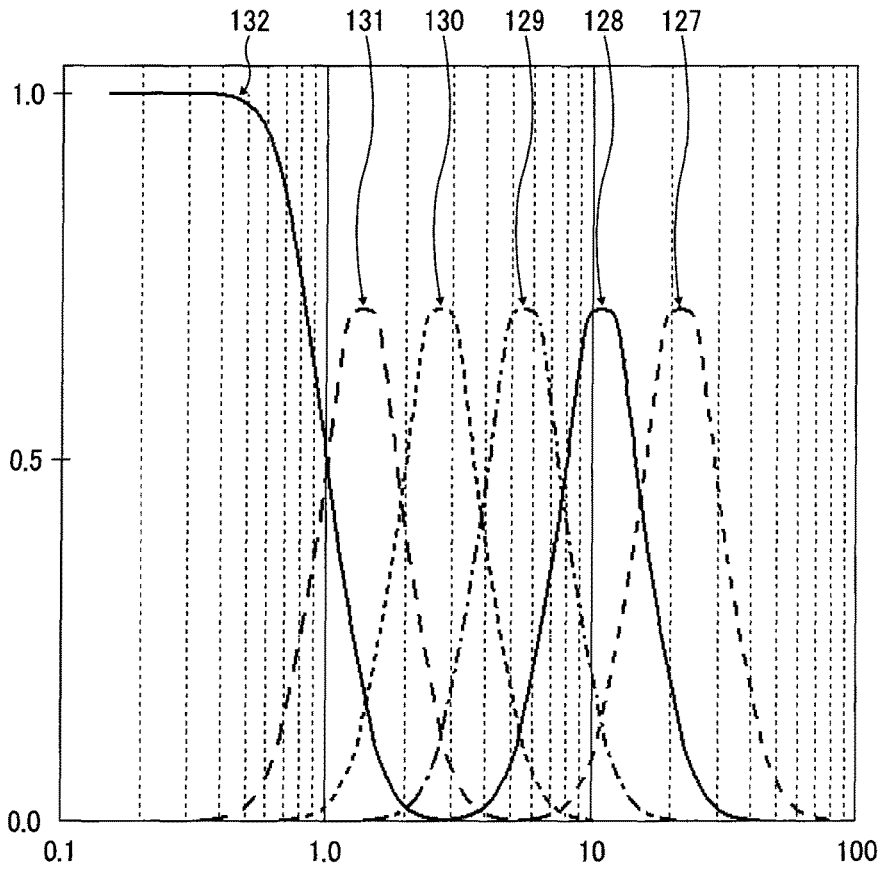
FIG. 8 is a graph illustrating separation of frequency bandwidth in multi-resolution analysis for the second time.

In the present invention, in FIG. 5C, there are six separated graphs by frequency and the state of the frequency separation is illustrated in FIG. 8.

In FIG. 8, the X axis is the number of the convexoconcave portions per mm when the forms of the convexoconcave portions are regarded as sign waves. In addition, the Y axis indicates the ratio when separated into each bandwidth.

In FIG. 8, 127 represents the bandwidth of the highest frequency component (LHH) in the second multi-resolution analysis, 128 is the bandwidth of the frequency component (second frequency component) one below the highest frequency component (LHL) in the second multi-resolution analysis, 129 is the bandwidth of the frequency component (third frequency component) two below the highest frequency component (LMH) in the second multi-resolution analysis, 130 is the bandwidth of the frequency component (fourth frequency component) three below the highest frequency component (LML) in the second multi-resolution analysis, 131 is the bandwidth the frequency component (fifth frequency component) of four below the highest frequency component (LLH) in the second multi-resolution analysis, and 132 is the bandwidth of the lowest frequency component (LLL) in the second multi-resolution analysis.

FIG. 8 is described in detail. When the number of the convexoconcave portions per mm is 0.2 or less, all appears in the graph 132.

For example, when the number of the convexoconcave portions per mm is 11, it appears highest in the graph 128, i.e., in the bandwidth of the frequency component one below the highest frequency component in the second multi-resolution analysis, meaning LML in FIG. 5C.

Therefore, in which of the six graphs of FIG. 5C the highest appears is determined depending on the frequency of the surface roughness.

In other words, in the surface roughness, fine roughness appears on the graphs situated on the top side in FIG. 5C and large surface waves appear on the bottom side of the graphs of FIG. 5C.

In the present disclosure, the surface roughness is decomposed by the frequency.

This is represented by the graphs of FIG. 5C. The surface roughness in each frequency bandwidth is obtained from the graph per frequency bandwidth. As the surface roughness, the arithmetical mean roughness Ra (WRa), the maximum height Rmax (WRmax), and the ten point height of irregularities RZ (WRz) are calculated.

Such single dimensional data arrangement obtained by measuring the convexoconcave portions of the surface of the photoconductor are subject to the multi-resolution analysis of separating into multiple frequency components from high frequency components to low frequency components by wavelet conversion, and the lowest frequency component obtained here is thinned-out to obtain another single dimensional data arrangement. The single dimensional data arrangement is furthermore subject to wavelet conversion to conduct multi-resolution analysis of separating into multiple frequency components from high frequency components to low frequency components. For the thus-obtained each frequency component, the surface texture and contour measuring instrument Ra (WRa)(μm), the maximum height Rmax (WRmax)(μm), and the ten point height of irregularities RZ (WRz)(μm) are calculated. The results are shown in Table 1.

TABLE 1

| | | Surface roughness obtained from multi resolution analysis | | |
|---|---|---|---|---|
| Number of multi resolution analysis | Signal | Arithmetic mean roughness (WRa) | Maximum height (WRmax) | Ten point height of irregularities (WRz) |
| First time | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| Second time | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

With regard to the profile curve of FIG. 5A, FIG. 5B, FIG. 5C, and FIG. 5D, the arithmetical mean roughness WRa obtained from the results of the multi-resolution analysis of the present disclosure are plotted according to the sequence of the signals and linked with lines to obtain a profile. In this plotting, since HLL component is an arithmetically extreme value, the surface roughness obtained from the results of multi-resolution analysis of this bandwidth is omitted. In the present disclosure, this graph (profile) is referred to as the surface roughness spectrum or the roughness spectrum. Since the component obtained by the wavelet conversion for the roughness curve of HLL is LHH component or LLL component, the data about HLL is reflected on LHH component or LLL component. For this reason, omitting HLL component does not cause a problem in the profile.

Figure 9:
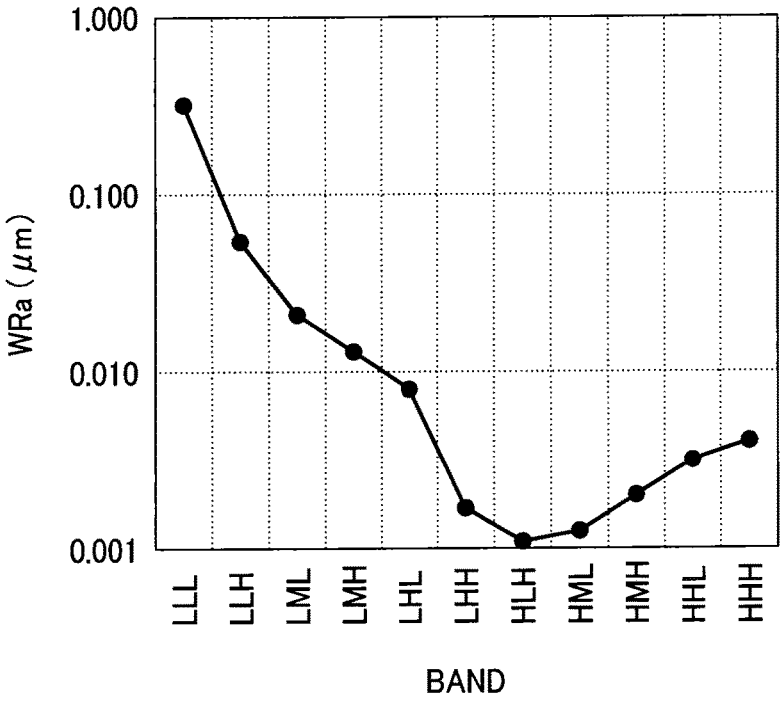
FIG. 9 is a graph illustrating an example of the surface roughness spectrum.

FIG. 9 is a graph illustrating an example of the surface roughness spectrum; In the present disclosure, of the twelve arithmetical mean roughness (Ra) of the total number of twelve frequency components, WRa (LLL) to WRa (HHH) excluding WRa (HLL) are evaluated to determine the surface texture. The photosensitive layer 25 has a WRa (LML) of from 0.02 μm to 0.03 μm, a WRa (LHL) of from 0.006 μm to 0.01 μm, and a WRa (HLH) of 0.001 μm or less.

In FIG. 9, an example is illustrated when WRa (HLH) is 0.001097 μm. However, when the value is rounded off, WRa (HLH) is not greater than 0.001 μm, which is thus within the present disclosure.

In addition, in the case in which the photosensitive layer 25 is a laminate formed of the charge generating layer 27 and the charge transport layer 29, the charge transport layer 29 preferably has a WRa (LML) and WRa (LHL) in the range mentioned above which are obtained in the same manner as the multi resolution analysis (MRA-1) and the multi resolution analysis (MRA-2) for the surface texture of the photosensitive layer 25. That is, it is preferable that the charge transport layer 29 has a WRa (LML) of from 0.02 μm to 0.03 μm, a WRa (LHL) of from 0.006 μm to 0.01 μm, and a WRa (HLH) of 0.001 μm or less.

Method of Manufacturing Photoconductor

The method of manufacturing the photoconductor of the present disclosure is described next. The method of manufacturing the photoconductor of the present disclosure includes at least applying a liquid application of photosensitive layer to the electroconductive substrate 21 followed by drying and other optional steps. As described above, WRa (LML) and WRa (LHL) of a photoconductor formed by a typical manufacturing method such as dip coating are about 0.01 μm and about 0.003 μm at highest, respectively. Therefore, in the present disclosure, it is preferable to manufacture a photoconductor by applying a liquid application followed by drying by spray coating in order to obtain desired values for WRa (LML) and WRa (LHL). There is no specific limit to the drying temperature and time. Preferably, the temperature ranges from 40° C. to 200° C. and the time is from 5 minutes to one hour. By adjusting the application interval resulting from the drying temperature, time, and speed, WRa (LML), WRa (LHL), and WRa (HLH) of the photoconductor can be controlled to target values in the present disclosure.

The liquid application of photosensitive layer can be applied to directly the electroconductive substrate 21 or other layers such as the intermediate layer 23. In addition, in the case of the photosensitive layer 25 having a laminate structure, a liquid application of charge generating layer is spray-coated first to the electroconductive substrate 21 to form the charge generating layer 27 and thereafter a liquid application of charge transport layer is spray-coated to form the charge transport layer 29.

Image Forming Method and Image Forming Apparatus

The image forming method and the image forming apparatus of the present disclosure are described next in detail. The image forming method is also referred to as electrophotography and the image forming apparatus is referred to as electrophotographic apparatus.

As described above, the image forming method of the present disclosure includes: charging the surface of a photoconductor; irradiating the surface of the charged photoconductor with light to write a latent electrostatic image on the surface of the photoconductor; developing the latent electrostatic image on the surface of the photoconductor with toner supplied thereto to form a toner image; transferring the toner image onto a recoding medium; fixing the toner image on the recording medium; and other optional steps.

The image forming method of the present disclosure is conducted by the image forming apparatus of the present disclosure. The image forming apparatus of the present disclosure includes a photoconductor to bear a latent electrostatic image; a charger to charge the surface of the photoconductor; an irradiator to irradiate the surface of the charged photoconductor with light to write the latent electrostatic image on the surface of the photoconductor, a developing device to develop the latent electrostatic image on the surface of the photoconductor with toner supplied thereto to form a toner image; a transfer device to transfer the toner image onto a recoding medium, a fixing device to fix the toner image on the recording medium; and other optional devices.

Figure 10:
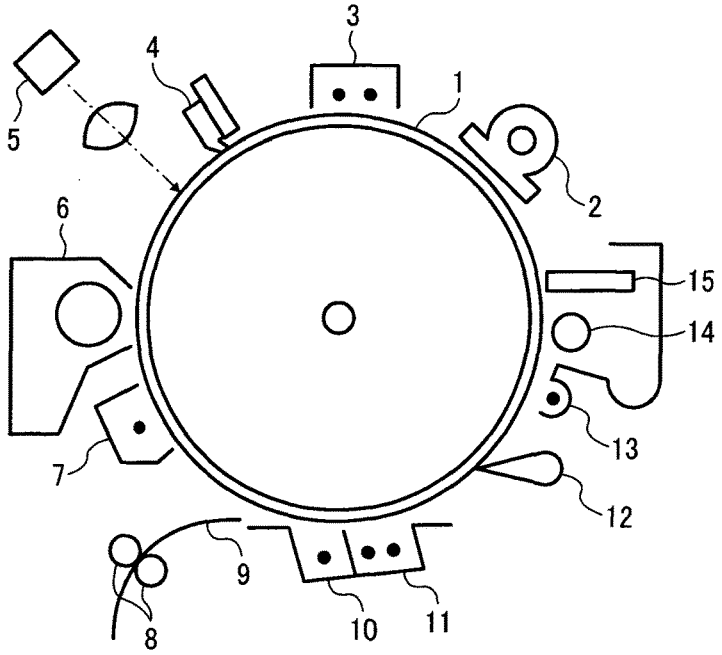
FIG. 10 is a schematic diagram illustrating an example of the image forming method and the image forming apparatus of the present disclosure.

FIG. 10 is a schematic diagram illustrating the image forming method (electrophotography) and the image forming apparatus of the present disclosure and the following variations are also within the scope of the present disclosure. Although a photoconductor 1 has a drum form in FIG. 10, it may employ a sheet-like form or endless belt form.

A corotron, a scorotron, a solid state charger, a charging roller, and any other known chargers can be used as a charger 3, a pre-transfer charger 7, a transfer charger 10, a separation charger 11, and a pre-cleaning charger 13.

Typically, the chargers described above can be used as the transfer device. A combinational use of the transfer charger and the separation charger as illustrated in FIG. 10 or a transfer roller is preferable.

In addition, any known luminescent material such as a fluorescent lamp, a tungsten lamp, a halogen lamp, a mercury lamp, a sodium lamp, a luminescent diode (LED), a semiconductor diode (LED), and electroluminescence (EL) can be suitably used as the light source for an image irradiation portion 5 as the irradiator and a discharging lamp 2.

Various kinds of optical filters, for example, a sharp cut filter, a band-pass filter, a near infrared filter, a dichroic filter, a coherent filter, and a color conversion filter, can be used to irradiate an image bearing member with light having only a particular wavelength range.

The light source, etc. also irradiates the photoconductor 1 in the processes in which irradiation is used in combination with processes such as the transfer process, the discharging process, and the cleaning process or a process such as a pre-irradiation process in addition to the process illustrated in FIG. 10. The reference numerals "4", "8", and "12" represent an eraser, a registration roller, and a separation claw, respectively.

Toner for use in developing the latent electrostatic image formed on the photoconductor 1 by a development unit 6 is transferred onto a transfer sheet 9. In this process, not all the toner is transferred but part of the toner remains on the photoconductor 1. Such remaining toner is removed from the photoconductor 1 by a fur brush 14 and/or a cleaning blade 15. Cleaning is performed only by a cleaning brush. Specific examples thereof include, but are not limited to, known cleaning brush such as fur brush and a magfur brush.

The image forming method of the present disclosure, further includes cleaning the surface of the photoconductor by a cleaning device pressed against the surface of the photoconductor 1. The contact pressure force to the surface of the photoconductor is preferably from 1.3 N·m to 1.5 N·m.

The image forming apparatus of the present disclosure, further includes a cleaning device to clean the surface of the photoconductor 1, which is pressed against the surface of the photoconductor 1. The contact pressure force to the surface of the photoconductor is preferably from 1.3 N·m to 1.5 N·m.

A plate supporting board and a cleaning blade formed of rubber board fixed to this plate supporting board is used as the cleaning device of the image forming apparatus in most cases. In such a case, the rubber board is provided in such a manner that the free end of the rubber board is pressed against the surface of the photoconductor with a predetermined contact pressure contact.

Figure 11:
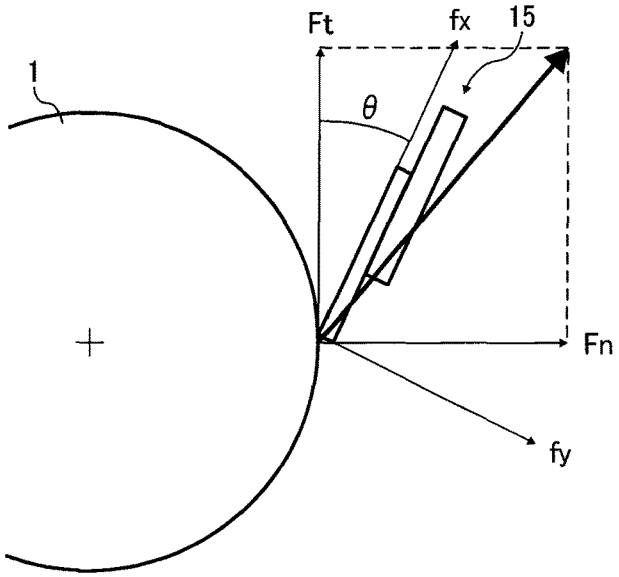
FIG. 11 is a schematic diagram illustrating the relation between the tangent force and the normal force.

Considering the length, the width, and the thickness of the rubber board of the cleaning blade about its positional relation, the load fx along the width direction (air surface) and the load fy along the thickness direction (cut surface) are obtained. FIG. 11 illustrates this relation.

When the contact angle between the cleaning blade and the photoconductor is defined as θ, the forces in the tangent direction and the perpendicular direction of the cleaning blade against the rotation drive direction of the photoconductor are calculated from the following relations 1 and 2.

$$Ft=fx\cdot\cos\theta-fy\cdot\sin\theta \quad \text{relation 1}$$

$$Fn=fx\cdot\sin\theta+fy\cdot\cos\theta \quad \text{relation 2}$$

The tangent force Ft represents the shear force between the photoconductor and the cleaning blade and the normal force Fn represents the compression force of these. The total force of these forces functions as contact pressure stress and corresponds to the contact pressure force of the cleaning blade to the surface of the photoconductor. The vector direction is estimated from the following relation 3.

$$\arctan(Ft/Fn) \quad \text{Relation 3}$$

Hereinafter, the cleaning blade is also referred to as the blade.

The blade that contacts the photoconductor gives a shear stress accompanied by the compressive stress. The compressive stress and the shear stress occur due to compression of rubber and the rotation drive of a drum. If the shear force is too strong, the blade flips.

Moreover, if the shear stress is too weak, it cannot resist the shear force of toner particles so that the toner particles slip through the blade. According to the relation 3, when the direction of the total force is 56 degree or more, the blade flips. When the direction of the total force is 35 degree or less, toner slips through.

This can be confirmed by using the device to measure the acting force disclosed in the paragraph [0039] of JP-2014-134605-A.

The contact pressure force corresponds to the sum (total) of Ft and Fn in FIG. 11 and can be calculated by the relation described above. On the other hand, evaluating the relation in the image forming apparatus described above is actually substituted by evaluating the torque amount to rotationarily drive the photoconductor the blade contacts as the contact pressure force of the photoconductor.

To calculate the torque amount, the effective value of a motor current is measured by oscilloscope to calculate percentage of the rated current of the motor first. Next, the motor shaft torque is obtained by multiplying the rated torque of the motor by this percentage.

Thereafter, the contact pressure force of the cleaning blade is calculated by multiplying the motor shaft torque by the reduction ratio of the gear via which the photoconductor is driven by the motor.

When the contact pressure force to the photoconductor of the present disclosure ranges from 1.3 N·m to 1.5 N·m, excellent features are demonstrated against background fouling and abrasion resistance.

There is no specific limit to the method of controlling the contact pressure force of the cleaning blade within the range of from 1.3 N·m to 1.5 N·m. For example, it is made possible by controlling the load of spring for loading to bring a cleaning blade into contact with the surface of a photoconductor.

In addition, when a photoconductor is positively (or negatively) charged and irradiated (exposed) imagewise, a positive (or negative) latent electrostatic image is formed on the photoconductor. If this latent electrostatic image is developed with a negatively (or positively) charged toner (volt-detecting fine particles), a positive image is formed. When the latent electrostatic image is developed using a positively (or negatively) charged toner, a negative image is formed. Any known method can be applied to such a development device and also a discharging device.

The image forming method (electrophotography) illustrated are for the illustration purpose only and the present disclosure is not limited thereto. For example, the image forming device that constitutes an image forming apparatus (electrophotographic apparatus) can be mounted in a photocopier, a facsimile machine, or a printer in a form of a cartridge.

The process cartridge is a device (part) including a photoconductor inside and at least one device selected from other optional devices such as a charger, an irradiator, a development device, a transfer device, a cleaner, and a discharging device. That is, the process cartridge can be configured to integrally have a photoconductor and a development device to develop a latent electrostatic image on the photoconductor and be detachably attachable to an image forming apparatus.

Figure 12:
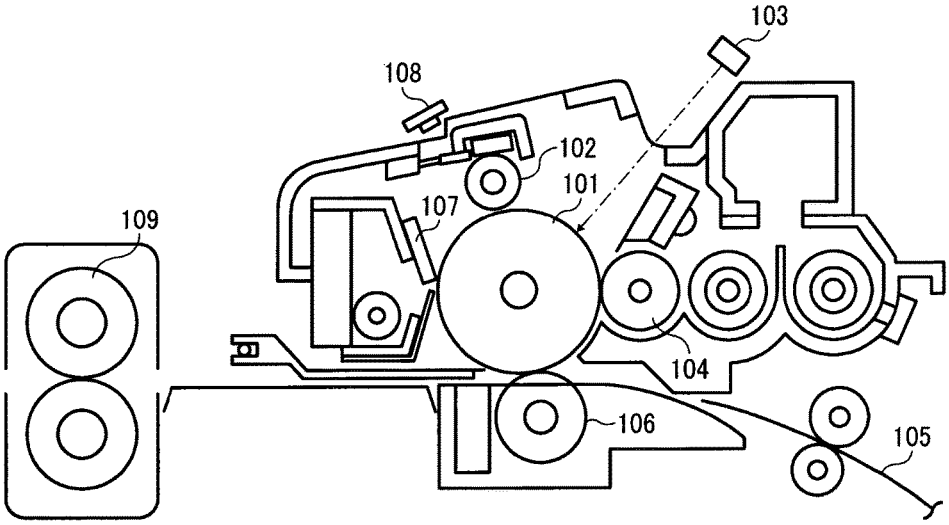
FIG. 12 is a diagram illustrating an example of an electrophotographic apparatus utilizing a process cartridge.

There are varieties with regard to the forms of the process cartridge. A typical form thereof is used in Imagio MF2000 (manufactured by Ricoh Company, Ltd.), which is illustrated in FIG. 12. FIG. 12 is a diagram illustrating an example of an electrophotographic apparatus utilizing a process cartridge, which is described below. In FIG. 12, the reference numeral 101 represents a photoconductor.

A charger 102 serving as charging device charges the photoconductor 101. After the photoconductor 101 is charged, an irradiator irradiates the photoconductor 101 with light 103. Charges are generated at irradiated portions, thereby forming a latent electrostatic image on the surface of the photoconductor 101. After forming the latent electrostatic image on the surface of the photoconductor 101, the surface contacts a development agent via a development device to form a toner image. The toner image formed on the surface of the photoconductor 101 is transferred to a transfer medium 105 such as paper by a transfer device 106 and thereafter passes through a fixing device 109 to make a photocopy.

A cleaning blade 107 removes toner remaining on the photoconductor 101 and a discharging lamp 108 removes remaining charges to be ready for the next image forming cycle. In this apparatus, the cartridge portion does not include the transfer medium 105, the transfer device 106, the discharging lamp 108, and the fixing device.

Although image irradiation, pre-cleaning irradiation, and discharging irradiation are illustrated as the light irradiation processes, other irradiation processes such as pre-transfer irradiation process, pre-image irradiation process, and other known irradiation processes can be provided to irradiate the photoconductor.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The liquid application of intermediate layer having the following recipe, the liquid application of charge generating layer having the following recipe, and the liquid application of charge transport layer having the following recipe were sequentially applied to an aluminum drum having a thickness of 3 mm, a length of 970 mm, and an outer diameter φ of 80 mm followed by drying to form an intermediate layer 23 having a thickness of 5 μm, a charge generating layer 27 having a thickness of 1 μm, and a charge transport layer 29 having a thickness of 30 μm.

Intermediate Layer

A mixture formed of the following recipe was dispersed in a ball mill for 72 hours to prepare a liquid application of intermediate layer.

Component of Liquid Application of Intermediate Layer

| | |
|---|---|
| Titanium oxide $T_1$ (purity: 99.7%, rutile ratio: 99.1%, average primary particle diameter: 0.25 (μm): | 120 parts |
| Titanium oxide $T_2$ (purity: 99.8%, antase type, average primary particle diameter: 0.4 μm): | 30 parts |
| Alkyd resin (Beckolite 6401-50, solid portion: 50%, manufactured by DIC Corporation): | 84 parts |
| Melamine resin (Super Beckamine G-821-60, solid portion: 60%, manufactured by DIC Corporation): | 47 parts |
| Methylethylketone: | 1,330 parts |
| Cyclohexanone: | 570 parts |

The thus-prepared liquid application of intermediate layer was spray-coated to a cut aluminum tube having a diameter φ of 80 mm and a length of 970 mm followed by drying at 150° C. for 35 minutes to form an intermediate layer 23 having a thickness of 5 μm, Charge Generating Layer A mill base formed of the following recipe was dispersed in a ball mill for 240 hours.

Composition of Mill Base

| | |
|---|---|
| Charge generating material A: asymmetry disazo pigment represented by the following chemical formula Y: | 24 parts |

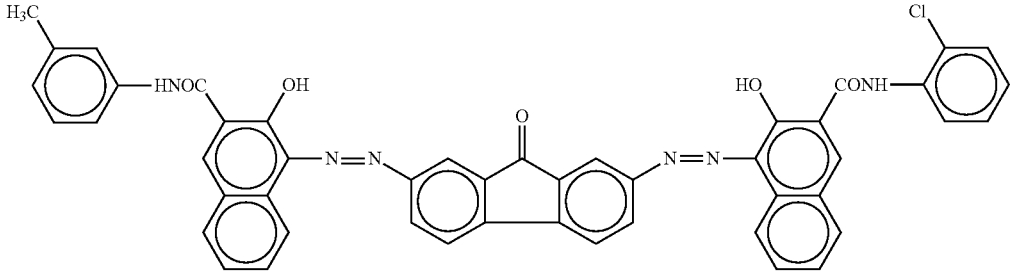

Chemical formula Y

| | |
|---|---|
| Charge generating material B: metal-free phthalocyanine pigment: | 12 parts |
| Binder resin: polyvinyl butyral (Butver-B90): | 7 parts |
| Solvent: cyclohexanone | 1,125 parts |

1,875 parts of cyclohexanone and 985 parts of 2-butanone were added to the thus obtained dispersed resultant for dispersion for three hours to prepare a liquid application of charge generating layer. The thus-obtained liquid application of charge generating layer was spray-coated to the intermediate layer to form a charge generating layer 27 having a thickness of 1 μm.

Charge Transport Layer

The following component was dissolved to prepare a liquid application of charge transport layer.

Composition of Liquid Application of Charge Transport Layer

| | |
|---|---|
| Charge transport material: compound represented by the following chemical formula X: | 6.5 parts |

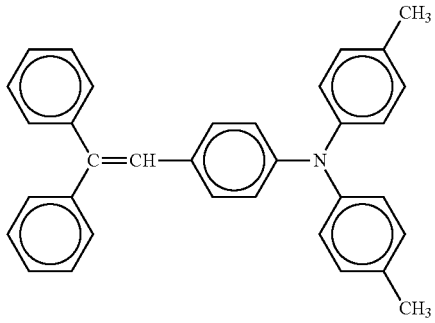

(X)

-continued

| Chemical formula X | |
|---|---|
| Binder resin: polycarbonate resin (TS-2040, manufactured by Teijin Chemicals Ltd. viscosity average molecular weight: 40,000): | 10 parts |
| Leveling agent: KF50-100CS (manufactured by Shin-Etsu Chemical Co., Ltd.) | 0.002 parts |
| Antioxidant: Sumilizer TPS (manufactured by Sumitomo Chemical Co. Ltd.): | 0.07 parts |
| Plasticizer: 1,4-bis(2,5-dimethyl benzyl) benzene: | 0.5 parts |
| Solvent A: tetrahydrofuran: | 81 parts |
| Solvent B: cyclohexanone: | 146 parts |

The thus-obtained liquid application of charge transport layer was applied to the charge generating layer followed by drying at 155° C. for 40 minutes in such a manner to form the charge transport layer 29 having an average thickness of 30 μm, thereby manufacturing a photoconductor.

Example 2

A photoconductor was manufactured in the same manner as in Example 1 except that WRa (LML) of the charge transport layer 29 was adjusted from 0.02 μm to 0.03 μm by adjusting the drying time due to repeating application of the liquid application of the charge transport layer 29.

Example 3

A photoconductor was manufactured in the same manner as in Example 1 except that WRa (LHL) of the charge transport layer 29 was adjusted from 0.007 μm to 0.01 μm by adjusting the drying time due to repeating application of the liquid application of the charge transport layer 29.

Example 4

A photoconductor was manufactured in the same manner as in Example 1 except that WRa (LHL) of the charge transport layer 29 was adjusted from 0.007 μm to 0.006 μm by adjusting the drying time due to repeating application of the liquid application of the charge transport layer 29.

Example 5

A photoconductor was manufactured in the same manner as in Example 1 except that no plasticizer of the charge transport layer 29 was used and the content of the charge transport material was changed from 6.5 parts to 7.0 parts.

Example 6

A photoconductor was manufactured in the same manner as in Example 1 except that the plasticizer was changed to butyl oleate.

Example 7

A photoconductor was manufactured in the same manner as in Example 1 except that the heating drying temperatures of the intermediate layer 23 and the charge transport layer 29 were changed as follows.

Heating drying temperature of the intermediate layer 23: changed from 150° C. to 130° C.

Heating drying temperature of the charge transport layer 29: changed from 155° C. to 130° C.

Example 8

A photoconductor was manufactured in the same manner as in Example 1 except that the heating drying temperatures of the intermediate layer 23 and the charge transport layer 29 were changed as follows.

Heating drying temperature of the intermediate layer 23: changed from 150° C. to 160° C.

Heating drying temperature of the charge transport layer 29: changed from 155° C. to 160° C.

Example 9

A photoconductor was manufactured in the same manner as in Example 1 except that the solvent of the intermediate layer 23 and the heating drying temperatures of the intermediate layer 23 and the charge transport layer 29 were changed as follows.

Methylethylketone: changed from 1,330 parts to 570 parts

Cyclohexanone: changed from 570 parts to 1,330 parts

Heating drying temperature of the intermediate layer 23: changed from 150° C. to 130° C.

Heating drying temperature of the charge transport layer 29: changed from 155° C. to 130° C.

Example 10

A photoconductor was manufactured in the same manner as in Example 1 except that the solvent of the intermediate layer 23 and the heating drying temperatures of the intermediate layer 23 and the charge transport layer 29 were changed as follows.

Methylethylketone: changed from 1,330 parts to 1,900 parts

Cyclohexanone: changed from 570 parts to 0 parts

Heating drying temperature of the intermediate layer 23: changed from 150° C. to 160° C.

Heating drying temperature of the charge transport layer 29: changed from 155° C. to 160° C.

Comparative Example 1

A photoconductor was manufactured in the same manner as in Example 1 except that the binder resin of the charge transport layer 29 was changed to 10 parts of polycarbonate resin (TS-2050, manufactured by Teijin Chemicals Ltd., viscosity average molecular weight: 50,000).

Comparative Example 2

A photoconductor was manufactured in the same manner as in Example 1 except that the component of the liquid application of charge transport layer was changed as follows.

Composition of Liquid Application of Charge Transport Layer

| | |
|---|---|
| Charge transport material: compound represented by the following chemical formula X: | 7 parts |

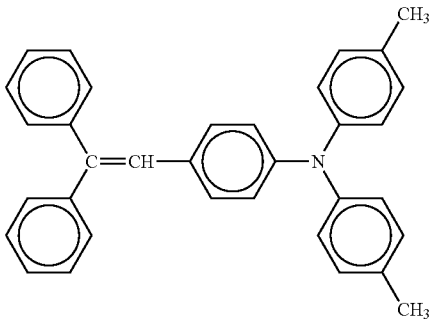

(X)

Chemical formula X

| | |
|---|---|
| Binder resin: polycarbonate resin (TS-2040, manufactured by Teijin Chemicals Ltd. viscosity average molecular weight: 40,000): | 10 parts |
| Leveling agent: KF50-100CS (manufactured by Shin-Etsu Chemical Co., Ltd.): | 0.002 parts |
| Antioxidant: 4-(1,1-dimethyl-3-phenyl-propyl)-biphenyl-2,5-diol: | 0.2 parts |
| Plasticizer: | None |
| Solvent A: tetrahydrofuran: | 83 parts |
| Solvent B: cyclohexanone: | 150 parts |

Comparative Example 3

A photoconductor was manufactured in the same manner as in Example 1 except that WRa (LML) of the charge transport layer 29 was adjusted from 0.02 μm to 0.01 μm by adjusting the drying time due to repeating application of the liquid application of the charge transport layer 29.

Comparative Example 4

A photoconductor was manufactured in the same manner as in Example 1 except that WRa (LML) of the charge transport layer 29 was adjusted from 0.02 μm to 0.04 μm by adjusting the drying time due to repeating application of the liquid application of the charge transport layer 29.

Comparative Example 5

A photoconductor was manufactured in the same manner as in Example 1 except that WRa (LHL) of the charge transport layer 29 was adjusted from 0.007 μm to 0.005 μm by adjusting the drying time due to repeating application of the liquid application of the charge transport layer 29.

Comparative Example 6

A photoconductor was manufactured in the same manner as in Example 1 except that WRa (LHL) of the charge transport layer 29 was adjusted from 0.007 μm to 0.012 μm by adjusting the drying time due to repeating application of the liquid application of the charge transport layer 29.

Comparative Example 7

A photoconductor was manufactured in the same manner as in Example 1 except that a cross-linked resin charge transport layer having the following component and a thickness of 3 μm was laminated on the charge transport layer 29.

Cross-Linked Resin Charge Transport Layer

| | |
|---|---|
| Cross-link type charge transport material represented by the following chemical formula Z: | 43 parts |

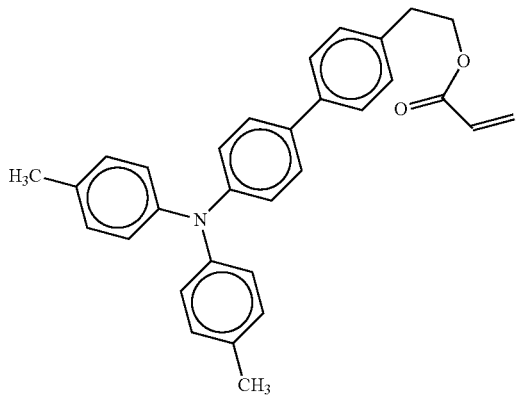

-continued

| Chemical formula Z | |
|---|---|
| Trimethylol propane triacrylate (KAYARAD TMPTA, manufactured by Nippon Kayaku Co., Ltd.): | 21 parts |
| Caprolactone modified dipentaerythritol hexaacrylate (KAYARAD DPCA 120, manufactured by Nippon Kayaku Co., Ltd.): | 21 parts |
| Mixture (BYK-UV3570, manufactured by BYK Chemie Japan) of acylic group contain- ing polyester modified polydimethyl siloxane and propoxy-modified-2-neopentyl glycol diacrylate: | 0.1 parts |
| 1-hydroxy-cyclohexy-phenyl ketone (IRGACURE 184, manufactured by Chiba Specialty Chemicals): | 4 parts |
| α-alumina (SUMICORUNDUM AA-03, manufactured by Sumitomo Chemical Co., Ltd.): | 7 parts |
| Dispersant (BYK-P104, manufactured by BYK Japan KK): | 0.2 parts |
| Tetrahydrofuran | 566 parts |

Test

The photoconductors manufactured in Examples 1 to 10 and Comparative Examples 1 to 7 and an image forming apparatus utilizing these were subject to the following tests 1 and 2. The evaluation results are shown in Table 2.

1. Measuring of Surface Texture of Photosensitive Layer (Charge Transport Layer) of Photoconductor The profile curve of the photosensitive layer 25 (charge transport layer 29) of the photoconductor was measured by a surface texture and contour measuring instrument (Surfcom 1400D, manufactured by Tokyo Seimitsu Co., Ltd.) while a pickup (E-DT-S02A) was attached, under the conditions that the measuring length was 12 mm, the number of total sampling was 30,720, and the measuring speed was 0.06 mm/s. The profile curve of the photosensitive layer 25 (charge transport layer 29) of the photoconductor immediately after manufacturing thereof was measured for an arbitrary point in the drum circumference direction from the end of the drum spaced 194 mm apart.

The single dimensional data arrangement of the surface texture of the photoconductor obtained by the measuring were subject to wavelet conversion to conduct multi-resolution analysis (MRA-1) to be separated into six frequency components from HHH to HLL. The thus-obtained single dimensional data arrangement of HLL was thinned out in such a manner that the number of data arrangement was reduced to 1/40 to obtain a thinned-out single dimensional data arrangement. The thinned-out single dimensional data arrangement was further subject to wavelet conversion to conduct multi-resolution analysis (MRA-2) to be separated into the six frequency components from LHH to LLL. The arithmetical mean roughness was calculated for each of the thus-obtained 12 frequency components.

This measuring of the surface texture was conducted at four points spaced 70 mm apart for a single photoconductor and the arithmetical mean roughness was calculated for each frequency component for each point.

Wavelet Toolbox of MATLAB (manufactured by The Matworks Inc.) was used as the wavelet conversion. As described above, the wavelet conversion was conducted on two separate occasions in the present disclosure.

The average of the arithmetical mean roughness of each frequency component for the four points was used as arithmetical mean roughness (WRa) of each frequency component of the measuring results.

2. Background Fouling Test

The photoconductor manufactured as described above was mounted onto imagio MP W7140 (manufactured by Ricoh Company, Ltd.) and a test image pattern having an image density of 6% was continuously printed at 25° C. and 55% RH. The charging voltage of the photoconductor when the test started was adjusted to be −800 V by a grid bias of the charger. The print paper was MyPaper (841 mm×200 m) manufactured by NBS Ricoh) and the text image was printed on the entire surface of the size of A1. The toner and the development agent used were proper products. Background fouling was rated 5 ranks and the printing was continued until background fouling became intolerable from a product market point of view. Background fouling durability was evaluated by the traveling distance of the testable photoconductor.

3. Analysis on Content Ratio of Cyclohexanone of Photoconductor

The photoconductor was cut into a suitable size for measuring including Al substrate.

The weight of the applied layer was obtained by subtracting the weight of the Al substrate from the cut material. Cyclohexanone contained in the photoconductor was analyzed by gas chromatography mass spectrometry (GCMS) method (Device: QP-2010, manufactured by Shimadzu Corporation, column Ultra ALLOY-5, L=30 m, I.D=0.25 mm, Film=0.25 μm).

TABLE 2

| | Travelling distance of photo-conductor (km) | Charge transport layer WRa (HLH) (μm) | Charge transport layer WRa (LHL) (μm) | Charge transport layer WRa (LML) (μm) | Content ratio of cyclohexanone in photoconductor (ppm) |
|---|---|---|---|---|---|
| Example 1 | 60 | 0.001 | 0.007 | 0.02 | 12 |
| Example 2 | 50 | 0.001 | 0.007 | 0.03 | 12 |
| Example 3 | 50 | 0.001 | 0.010 | 0.02 | 12 |
| Example 4 | 50 | 0.001 | 0.006 | 0.02 | 12 |
| Example 5 | 40 | 0.001 | 0.010 | 0.03 | 10 |
| Example 6 | 45 | 0.001 | 0.008 | 0.02 | 11 |
| Example 7 | 50 | 0.001 | 0.007 | 0.02 | 11 |
| Example 8 | 50 | 0.001 | 0.007 | 0.02 | 11 |
| Example 9 | 40 | 0.001 | 0.007 | 0.02 | 200 |
| Example 10 | 40 | 0.001 | 0.007 | 0.02 | 8 |
| Comparative Example 1 | 25 | 0.001 | 0.020 | 0.05 | 12 |
| Comparative Example 2 | 25 | 0.001 | 0.005 | 0.07 | 11 |
| Comparative Example 3 | 25 | 0.001 | 0.007 | 0.01 | 12 |
| Comparative Example 4 | 25 | 0.001 | 0.007 | 0.04 | 12 |
| Comparative Example 5 | 25 | 0.001 | 0.005 | 0.02 | 13 |

TABLE 2-continued

| | Travelling distance of photo-conductor (km) | Charge transport layer WRa (HLH) (μm) | Charge transport layer WRa (LHL) (μm) | Charge transport layer WRa (LML) (μm) | Content ratio of cyclohexanone in photoconductor (ppm) |
|---|---|---|---|---|---|
| Comparative Example 6 | 25 | 0.001 | 0.012 | 0.02 | 13 |
| Comparative Example 7 | 25 | 0.004 | 0.010 | 0.03 | 10 |

As seen in the results shown in Table 2, the photoconductors of the present disclosure having a charge transport layer having a surface texture with WRa (LML) of from 0.02 μm to 0.03 μm, WRa (LHL) of from 0.006 μm to 0.01 μm, and WRa (HLH) of 0.001 μm or less were free from background fouling and had excellent durability, which was shown by the traveling distance of 40 km or more. In addition, life length against background fouling varies depending on the content of cyclohexane in the photoconductor. Any of the photoconductor in the present disclosure demonstrates long working life against background fouling.

Example 11

The photoconductor of Example 1 was mounted onto a digital wide length photocopier (imagio MP W7140, manufactured by Ricoh Company, Ltd.) and a checker flag pattern image having an average image density of 50% at 25° C. and 55% RH was continuously printed with a run length of 10,000 sheets. In the digital wide length photocopier for use in Examples 1 to 10 and Comparative Examples 1 to 7, a spring for loading having a load of 13.0 N when expanded by 65 mm was used to apply a load to the cleaning blade installed into the photocopier to contact the surface of the photoconductor with a predetermined contact pressure force. This spring was used as was in Example 11.

The charging voltage of the photoconductor when the test started was adjusted to be −800 V by a grid bias of the charger. The print paper was MyPaper (841 mm×200 m) manufactured by NBS Ricoh) and the pattern image was printed on the entire surface of the size of A1. The toner and the development agent used were proper products. At the end of the test, the image area ratio of background fouling when all white pattern image was printed was evaluated by five levels. Background fouling was evaluated for print images acquired through an image scanner of 600 dpi utilizing image analysis software (imageJ, distributed by US National Institutes of Health, NIH). The evaluation criteria are as follows:

Background Fouling Evaluation Criteria

Rank 5: less than 0.1%

Rank 4: 0.1% to less than 0.2%

Rank 3: 0.2% to less than 0.7%

Rank 2: 0.7% to less than 2.9%

Rank 1: 2.9% or greater

Before starting the test, in a state in which the cleaning blade was brought into contact with the photoconductor with pressure, the effective value of the motor current in the state in which the photoconductor was rotationarily driven was measured by oscilloscope (TDS 3054, manufactured by Tecktroniks) with a current probe (TCP202, manufactured by Tektroniks). This effective value was calculated as percentage of the rated current of the motor. The motor shaft torque was obtained by multiplying this percentage by the rated torque of the motor. The contact pressure force was calculated by multiplying the motor shaft torque by the reduction rate 1/62 of the gear via which the photoconductor was driven by the motor. Next, the abrasion amount of the photoconductor accompanied by the durability test was measured by Fischerscope mms (manufactured by Fischer).

Example 12

A test was conducted in the same manner as in Example 11 except that the spring for loading was changed to a spring having 12.4 N when expanded by 65 mm.

Example 13

A test was conducted in the same manner as in Example 11 except that the spring for loading was changed to a spring having 11.0 N when expanded by 65 mm.

Example 13

A test was conducted in the same manner as in Example 11 except that the spring for loading was changed to a spring having 9.7 N when expanded by 65 mm.

Example 14

A test was conducted in the same manner as in Example 11 except that the spring for loading was changed to a spring having 9.0 N when expanded by 65 mm.

Comparative Example 8

A test was conducted in the same manner as in Example 13 except that the photoconductor was changed to that of Comparative Example 1.

Comparative Example 9

A test was conducted in the same manner as in Example 15 except that the photoconductor was changed to that of Comparative Example 1.

The test results of Examples 11 to 14 and Comparative Examples 8 and 9 were shown in Table 3.

TABLE 3

| | Contact pressure force (N · m) | Background fouling (rating) | Abrasion amount (μm) |
|---|---|---|---|
| Example 11 | 1.55 | 5 | 1.4 |
| Example 12 | 1.50 | 5 | 1.0 |
| Example 13 | 1.40 | 5 | 0.8 |
| Example 14 | 1.30 | 5 | 0.6 |
| Example 15 | 1.25 | 4 | 0.6 |
| Comparative Example 8 | 1.50 | 3 | 1.9 |
| Comparative Example 9 | 1.32 | 3 | 1.0 |

As seen in Table 3, the image forming apparatuses of Examples 11 to 14 are excellent to suppress background fouling.

In particular, the photoconductors of Examples 12, 13, and 14 have low abrasion speed, which is advantageous to prolong the working life length of the photoconductors.

The photoconductor of Example 11 has a relatively high abrasion speed. Although Example 15 is excellent about background fouling and abrasion resistance in comparison with Comparative Examples 8 and 9, the performance of Example 15 is one level below Examples 12, 13, and 14. The contact pressure force between the cleaner and the photoconductor is inferentially insufficient. Comparative Examples 8 and 9 are inferior to all of Examples 11 to 15. This is inferred that the surface textures of the photoconductors had adverse impacts. The surfaces of the photoconductors of Examples 13 and 15 which are comparison subjects of Comparative Examples 8 and 9 have textures to ease the contact pressure force with the blade.

These contribute to suppressing abrasion of the photoconductor and maintaining good states against background fouling in these image forming method and image forming apparatuses.

Since the photoconductor of the present disclosure suppresses background fouling and has a good durability (long working life), production of defective images caused by uneven image density and background fouling is suppressed for repetitive use for an extended period of time, so that quality images are stably produced. By using such a photoconductor, high speed performance, size reduction, colorization, image quality improvement, and easy maintenance, which are strongly demanded for the image forming apparatus such as a photocopier, a laser printer, or a facsimile machine and the image forming method, can be achieved.

According to the present disclosure, a photoconductor is provided which suppresses background fouling and has excellent durability.

Having now fully described embodiments of the present invention, it will be apparent to one of ordinary skill in the art that many changes and modifications can be made thereto without departing from the spirit and scope of embodiments of the invention as set forth herein.

What is claimed is:

1. A photoconductor, comprising:

an electroconductive substrate; and a photosensitive layer provided overlying the electroconductive substrate, wherein:

the photosensitive layer comprises a laminate comprising a charge generating layer and a charge transport layer in a direction of thickness of the photosensitive layer;

the charge transport layer comprises a thermoplastic resin which is a bisphenol Z type polycarbonate having a viscosity average molecular weight of from 40,000 to less than 50,000;

the charge transport layer comprises a plasticizer;

the charge transport layer contains no cross-linked resin as a binder resin;

in a curve obtained by:

(I) measuring a convexoconcave form by a surface texture and contour measuring instrument to make a single dimensional data arrangement, (II) conducting multi-resolution analysis (MRA-1) by wavelet conversion of the single dimensional data arrangement to separate into six frequency components of from a highest frequency component (HHH) a second frequency component (HHL), a third frequency components (HMH), a fourth frequency component (HML), a fifth frequency component (HLH), and a lowest frequency component (HLL), (III) making a single dimensional data arrangement by thinning out a single dimensional data arrangement of the lowest frequency component (HLL) of the six frequency components such that a number of data arrangements is reduced to 1/10 to 1/100, (IV) conducting further wavelet conversion for the single dimensional data arrangement obtained by thinning-out to conduct multi-resolution analysis (MRA-2) to separate into additional six frequency components of a highest frequency component (LHH), a second frequency component (LHL), a third frequency components (LMH), a fourth frequency component (LML), a fifth frequency component (LLH), and a lowest frequency component (LLL), and (V) of arithmetical mean roughness (WRa) of a total number of twelve frequency components obtained in (II) and (IV), connecting logarithms of eleven WRa's of WRa (LLL) to WRa (HHH) from left to right excluding WRa (HLL), a surface of the photosensitive layer has a WRa (LML) of from 0.02 μm to 0.03 μm, a WRa (LHL) of from 0.006 μm to 0.01 μm, and a WRa (HLH) of 0.001 μm or less; and the arithmetical mean roughness (WRa) are defined as Ra in JIS-B0601:2001 and WRa (HHH) to WRa (LLL) represent individual Ra's in the following bandwidths:

WRa (HHH): Ra in a bandwidth in which a cycle length of convexoconcave ranges from 0 μm to 3 μm;

WRa (HHL): Ra in a bandwidth in which a cycle length of convexoconcave ranges from 1 μm to 6 μm;

WRa (HMH): Ra in a bandwidth in which a cycle length of convexoconcave ranges from 2 μm to 13 μm;

WRa (HML): Ra in a bandwidth in which a cycle length of convexoconcave ranges from 4 μm to 25 μm;

WRa (HLH): Ra in a bandwidth in which a cycle length of convexoconcave ranges from 10 μm to 50 μm;

WRa (LHH): Ra in a bandwidth in which a cycle length of convexoconcave ranges from 26 μm to 106 μm;

WRa (LHL): Ra in a bandwidth in which a cycle length of convexoconcave ranges from 53 μm to 183 μm;

WR a (LMH): Ra in a bandwidth in which a cycle length of convexoconcave ranges from 106 μm to 318 μm;

WRa (LML): Ra in a bandwidth in which a cycle length of convexoconcave ranges from 214 μm to 551 μm;

WRa (LLH): Ra in a bandwidth in which a cycle length of convexoconcave ranges from 431 μm to 954 μm;

WRa (LLL): Ra in a bandwidth in which a cycle length of convexoconcave ranges from 867 μm to 1,654 μm.

2. The photoconductor according to claim 1, wherein the plasticizer is selected from the group consisting of a halogenized paraffin, a dimethyl naphthalene, dibutyl phosphine, dioctyl phthalate, tricresyl phosphate, and polymers and copolymers of such as polyesters.

3. The photoconductor according to claim 1, wherein the plasticizer is 1,4-bis(2,5-dimethylbenzyl)benzene.

4. The photoconductor according to claim 1, further comprising cyclohexanone accounting for 10 ppm to 100 ppm.

5. A method of manufacturing the photoconductor of claim 1, the method comprising:

spray-coating the electroconductive substrate of the photoconductor of claim 1 with a liquid application of the photosensitive layer of the photoconductor of claim 1; and drying the liquid application.

6. An image forming method, comprising:

charging a surface of the photoconductor of claim 1;

irradiating the surface of the photoconductor with light to write a latent electrostatic image on the surface of the photoconductor;

developing the latent electrostatic image on the surface of the photoconductor with toner supplied thereto to form a toner image; and transferring the toner image onto a recoding medium; and fixing the toner image on the recording medium.

7. The image forming method according to claim 6, further comprising cleaning the surface of the photoconductor by a cleaner pressed against the surface of the photoconductor with a contact pressure force to the surface of the photoconductor of from 1.3 N·m to 1.5 N·m.

8. An image forming apparatus, comprising:

the photoconductor of claim 1 to bear a latent electrostatic image;

a charger to charge a surface of the photoconductor;

an irradiator to irradiate the surface of the photoconductor with light to write the latent electrostatic image on the surface of the photoconductor;

a developing device to develop the latent electrostatic image on the surface of the photoconductor with toner supplied thereto to form a toner image;

a transfer device to transfer the toner image onto a recoding medium; and a fixing device to fix the toner image on the recording medium.

9. The image forming apparatus according to claim 8, further comprising a cleaner to clean the surface of the photoconductor by being pressed against the surface of the photoconductor with a contact pressure force thereto of from 1.3 N·m in to 1.5 N·m.

* * * * *